US007967948B2

(12) United States Patent
Nguyen

(10) Patent No.: US 7,967,948 B2
(45) **Date of Patent: *Jun. 28, 2011**

(54) PROCESS FOR NON-CHLORINE OXIDATIVE BLEACHING OF MECHANICAL PULP IN THE PRESENCE OF OPTICAL BRIGHTENING AGENTS

(75) Inventor: Xuan Truong Nguyen, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 32 days.

This patent is subject to a terminal disclaimer.

(21) Appl. No.: 11/446,421

(22) Filed: Jun. 2, 2006

(65) Prior Publication Data

US 2007/0277947 A1 Dec. 6, 2007

(51) Int. Cl.
*D21C 9/10* (2006.01)

(52) U.S. Cl. ..... 162/71; 162/21; 162/72; 8/156

(58) Field of Classification Search ..... 162/72, 162/21, 71; 8/156

See application file for complete search history.

(56) References Cited

U.S. PATENT DOCUMENTS

| | | | | |
|---|---|---|---|---|
| 3,193,445 | A * | 7/1965 | Parker et al. | 162/76 |
| 3,388,037 | A | 6/1968 | Asplund et al. | |
| 3,467,574 | A | 9/1969 | West | |
| 3,661,320 | A | 5/1972 | Donaldson | |
| 3,804,944 | A | 4/1974 | Kise et al. | |
| 3,847,363 | A | 11/1974 | Reinhall | |
| 3,873,412 | A | 3/1975 | Charters et al. | |
| 3,985,674 | A | 10/1976 | Ellis et al. | |
| 4,012,279 | A | 3/1977 | Selander et al. | |
| 4,136,831 | A | 1/1979 | Cederquist et al. | |
| 4,169,810 | A | 10/1979 | Gunther et al. | |
| 4,225,385 | A | 9/1980 | Hughes, Jr. et al. | |
| 4,235,665 | A | 11/1980 | Reinhall et al. | |
| 4,312,634 | A * | 1/1982 | Katz | 8/111 |
| 4,534,954 | A | 8/1985 | Little et al. | |
| 4,576,609 | A * | 3/1986 | Hageman et al. | 8/103 |
| 4,676,961 | A | 6/1987 | Appl et al. | |
| 4,756,799 | A | 7/1988 | Bengtsson et al. | |
| 4,767,499 | A | 8/1988 | Simonson et al. | |

(Continued)

FOREIGN PATENT DOCUMENTS

DE 19953590 11/1999

(Continued)

OTHER PUBLICATIONS

Smook, Handbook for Pulp and Paper Technologists, 1992, Angus Wide Publications, 2nd Edition, p. 36, 184, and 228.*

(Continued)

*Primary Examiner* — Matthew J Daniels
*Assistant Examiner* — Anthony J Calandra
(74) *Attorney, Agent, or Firm* — Thomas W. Barnes, III; John K. Pike; Richard C. Stewart, III

(57) ABSTRACT

A process for bleaching mechanical wood pulp is provided comprising subjecting the wood pulp to at least one bleaching stage with one or more bleaching agents in the presence of one or more optical brightening agent, wherein the bleaching agents are selected from the group consisting of oxidative bleaching agents other than chlorine based bleaching agents such as chlorine dioxide, elemental chlorine or a combination thereof, reductive bleaching agents or any combination of two or more thereof.

24 Claims, 8 Drawing Sheets

U.S. PATENT DOCUMENTS

| | | | | |
|---|---|---|---|---|
| 5,035,772 | A * | 7/1991 | Agnemo et al. | 162/72 |
| 5,129,987 | A | 7/1992 | Joachimides et al. | |
| 5,292,422 | A | 3/1994 | Liang et al. | |
| 5,482,514 | A | 1/1996 | von Raven | |
| 5,616,280 | A * | 4/1997 | Moore et al. | 252/186.29 |
| 5,766,159 | A | 6/1998 | Martin et al. | |
| 5,800,418 | A * | 9/1998 | Ahr | 604/368 |
| 5,902,454 | A | 5/1999 | Nelson | |
| 6,063,982 | A | 5/2000 | Martin et al. | |
| 6,136,041 | A | 10/2000 | Jaschinski et al. | |
| 6,302,999 | B1 | 10/2001 | Engelhardt et al. | |
| 6,426,382 | B1 | 7/2002 | Farrar et al. | |
| 6,464,832 | B2 | 10/2002 | Engelhardt et al. | |
| 6,527,914 | B1 | 3/2003 | Shevchenko et al. | |
| 6,537,680 | B1 * | 3/2003 | Norlander et al. | 428/532 |
| 6,632,328 | B2 * | 10/2003 | Wan et al. | 162/78 |
| 6,649,037 | B2 | 11/2003 | Liang et al. | |
| 6,723,846 | B1 | 4/2004 | Metzger et al. | |
| 6,743,332 | B2 | 6/2004 | Haynes et al. | |
| 6,890,454 | B2 | 5/2005 | Farrar et al. | |
| 6,893,473 | B2 | 5/2005 | Neogi et al. | |
| 7,176,344 | B2 * | 2/2007 | Gustafson et al. | 604/361 |
| 2002/0084049 | A1 * | 7/2002 | Engelhardt et al. | 162/158 |
| 2003/0013628 | A1 | 1/2003 | Farrar et al. | |
| 2003/0208859 | A1 * | 11/2003 | Neogi et al. | 8/919 |
| 2004/0014910 | A1 | 1/2004 | Wang | |
| 2004/0040679 | A1 | 3/2004 | Kilgannon et al. | |
| 2004/0050511 | A1 * | 3/2004 | Lambert | 162/76 |
| 2004/0065423 | A1 | 4/2004 | Swerin et al. | |
| 2004/0142843 | A1 | 7/2004 | Schlingloff et al. | |
| 2004/0169903 | A1 | 9/2004 | Kreuzer et al. | |
| 2004/0180184 | A1 | 9/2004 | Fillion et al. | |
| 2006/0185808 | A1 | 8/2006 | Nguyen | |
| 2007/0000627 | A1 | 1/2007 | Tan et al. | |
| 2007/0044929 | A1 | 3/2007 | Mohan et al. | |
| 2007/0062653 | A1 * | 3/2007 | Duggirala et al. | 162/9 |
| 2007/0193707 | A1 | 8/2007 | Nguyen | |
| 2007/0277947 | A1 | 12/2007 | Nguyen | |
| 2008/0006878 | A1 | 1/2008 | Yoo et al. | |
| 2008/0017337 | A1 | 1/2008 | Duggirala et al. | |

FOREIGN PATENT DOCUMENTS

| | | |
|---|---|---|
| EP | 0018287 | 10/1980 |
| EP | 0905317 | 3/1999 |
| EP | 1811080 | 7/2007 |
| WO | WO 90/11403 | 10/1990 |
| WO | WO 96/00221 | 1/1996 |
| WO | WO 99/29779 | 6/1999 |
| WO | 0152911 | 7/2001 |
| WO | WO 2006/110751 | 10/2006 |
| WO | WO 03/074780 | 12/2007 |

OTHER PUBLICATIONS

American Printer, Paper 101 the basics [downloaded online from www.americanprinter.com], downloaded Jul. 15, 2009, American Printer.*

Axiphos, On whiteness forumulas, May 2002, Axiphos GmbH, p. 7.*

Paper Machinery, Definition of Fluff Pulp [downloaded online from www.paper-machinery.com], downloaded on Jul. 27, 2009, Paper machinery, whole document.*

Paulsson et al., Chemical Modification of Lignin-Rich Paper Part 7, Apr. 1998, IPST, IPST Technical series No. 718, whole document.*

Smook, Handbook for Pulp and Paper Technologists, 1992, Angus Wilde Publications, 2nd edition, p. 247-250.*

Smook, Handbook for Pulp and Paper Technologists, 1992, Angus Wilde Publications, 2nd edition, chapter 11.*

Hydrogen Peroxide [downloaded online from chemicalland21.com], downloaded on Jun. 9, 2010.*

Chappell et al., Strength properties of slimes due to dewatering and electro-grouting, 1997, GeoEnvironment 97, p. 408.*

Hydrogen Peroxide (downloaded online from chemicalland21.com), downloaded on Jun. 9, 2010.

* cited by examiner

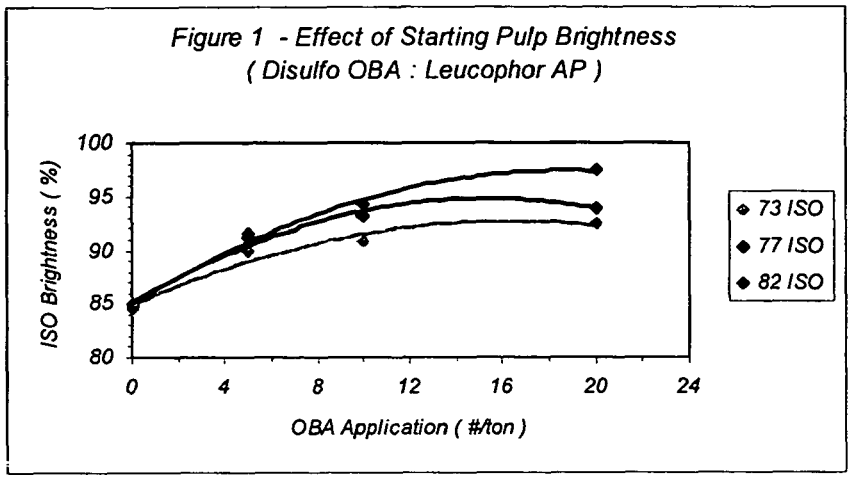
Figure 1 - Effect of Starting Pulp Brightness
( Disulfo OBA : Leucophor AP )
ISO Brightness ( %)
100
95
90
85
80
0
4
8
12
16
20
24
OBA Application ( #/ton )
73 ISO
77 ISO
82 ISO
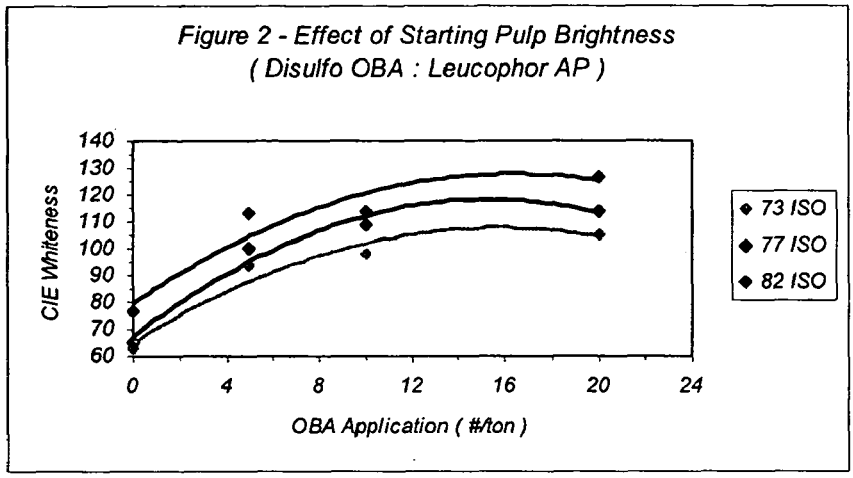
Figure 2 - Effect of Starting Pulp Brightness
( Disulfo OBA : Leucophor AP )
CIE Whiteness
140
130
120
110
100
90
80
70
60
0
4
8
12
16
20
24
OBA Application ( #/ton )
73 ISO
77 ISO
82 ISO
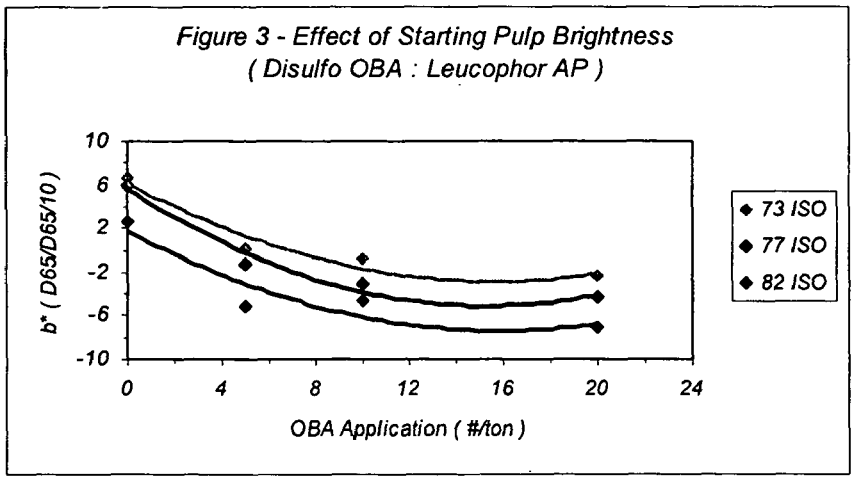
Figure 3 - Effect of Starting Pulp Brightness
( Disulfo OBA : Leucophor AP )
b* ( D65/D65/10 )
10
6
2
-2
-6
-10
0
4
8
12
16
20
24
OBA Application ( #/ton )
73 ISO
77 ISO
82 ISO

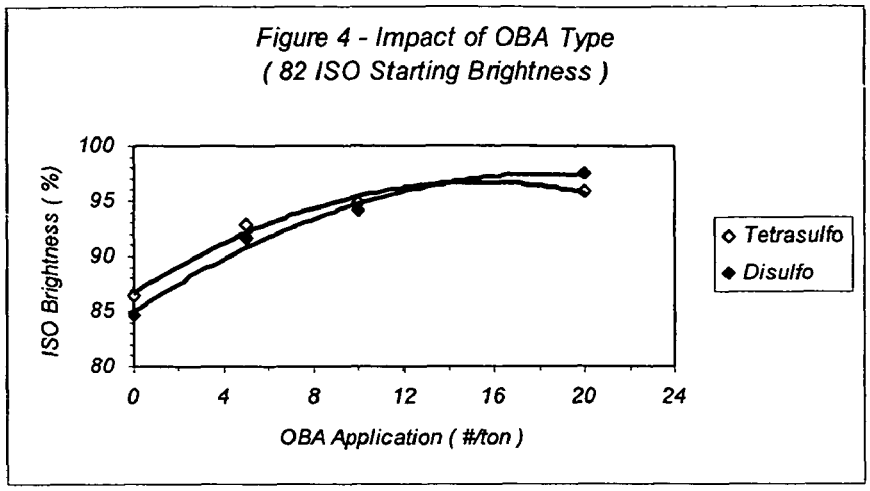
Figure 4 - Impact of OBA Type
( 82 ISO Starting Brightness )
ISO Brightness ( %)
100
95
90
85
80
0
4
8
12
16
20
24
OBA Application ( #/ton )
Tetrasulfo
Disulfo
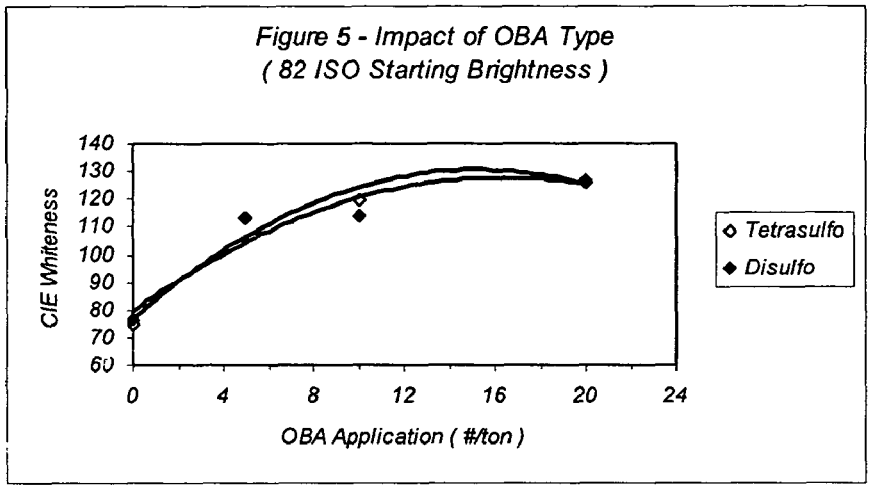
Figure 5 - Impact of OBA Type
( 82 ISO Starting Brightness )
CIE Whiteness
140
130
120
110
100
90
80
70
60
0
4
8
12
16
20
24
OBA Application ( #/ton )
Tetrasulfo
Disulfo
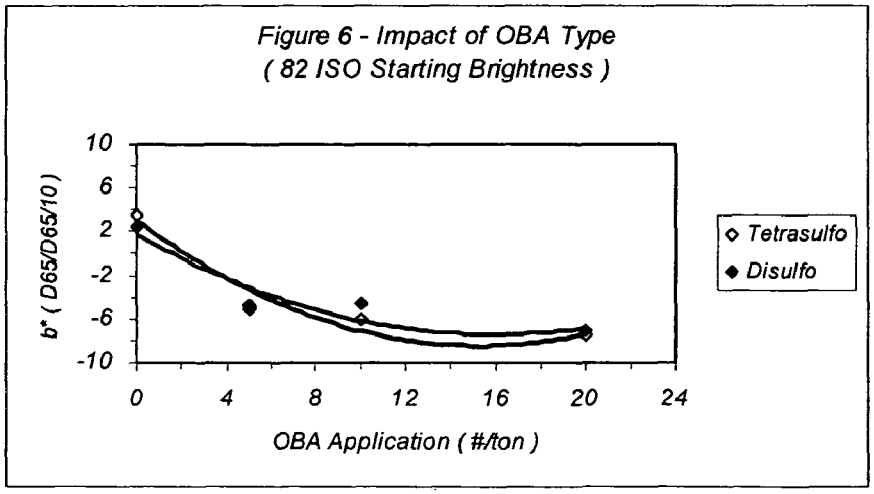
Figure 6 - Impact of OBA Type
( 82 ISO Starting Brightness )
b* ( D65/D65/10 )
10
6
2
-2
-6
-10
0
4
8
12
16
20
24
OBA Application ( #/ton )
Tetrasulfo
Disulfo

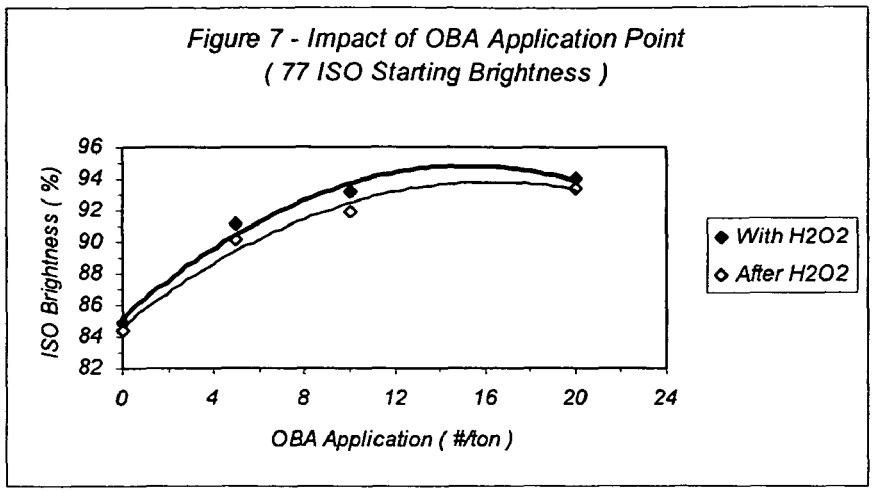
Figure 7 - Impact of OBA Application Point
( 77 ISO Starting Brightness )
ISO Brightness ( %)
96
94
92
90
88
86
84
82
0
4
8
12
16
20
24
OBA Application ( #/ton )
With H2O2
After H2O2
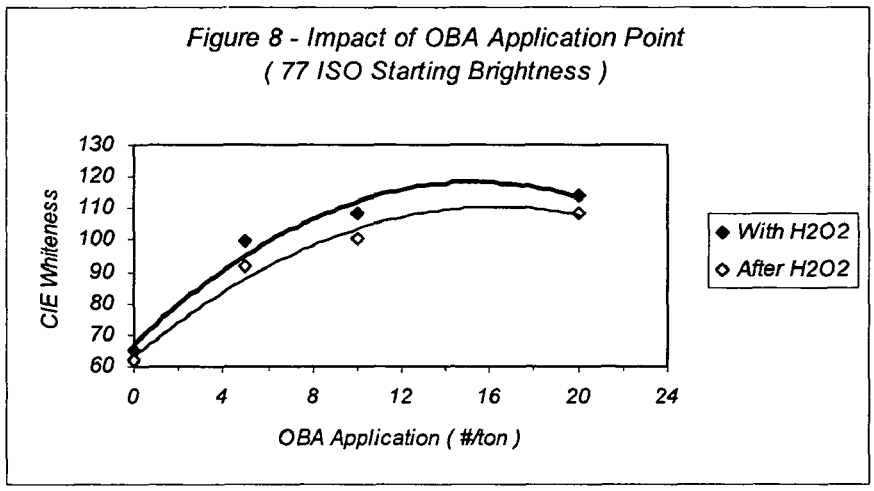
Figure 8 - Impact of OBA Application Point
( 77 ISO Starting Brightness )
CIE Whiteness
130
120
110
100
90
80
70
60
0
4
8
12
16
20
24
OBA Application ( #/ton )
With H2O2
After H2O2
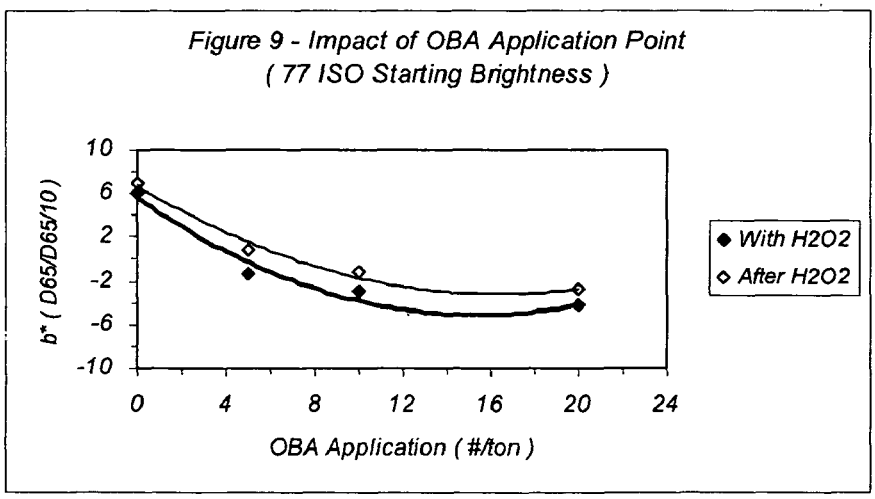
Figure 9 - Impact of OBA Application Point
( 77 ISO Starting Brightness )
b* ( D65/D65/10 )
10
6
2
-2
-6
-10
0
4
8
12
16
20
24
OBA Application ( #/ton )
With H2O2
After H2O2

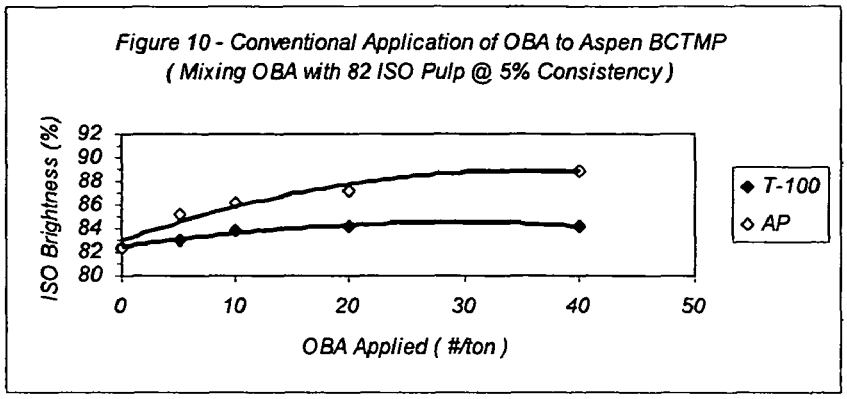
Figure 10 - Conventional Application of OBA to Aspen BCTMP
( Mixing OBA with 82 ISO Pulp @ 5% Consistency )
ISO Brightness (%)
92
90
88
86
84
82
80
0
10
20
30
40
50
OBA Applied ( #/ton )
T-100
AP

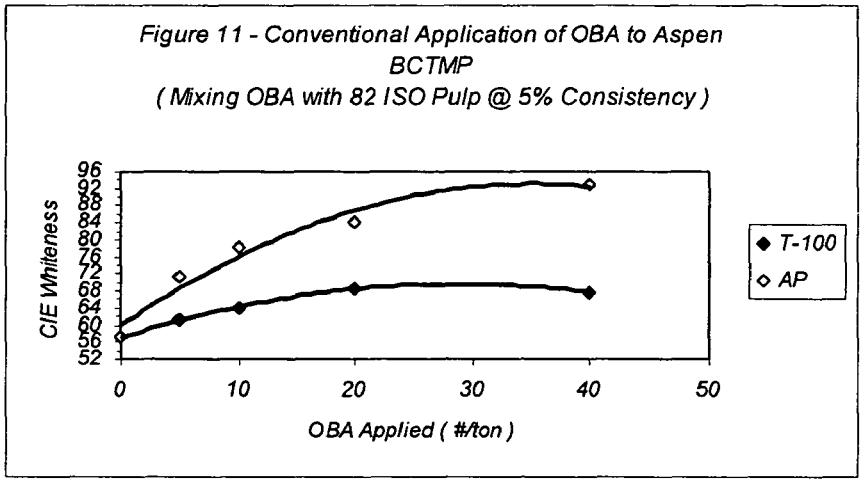
Figure 11 - Conventional Application of OBA to Aspen BCTMP
( Mixing OBA with 82 ISO Pulp @ 5% Consistency )
CIE Whiteness
96
92
88
84
80
76
72
68
64
60
56
52
0
10
20
30
40
50
OBA Applied ( #/ton )
T-100
AP

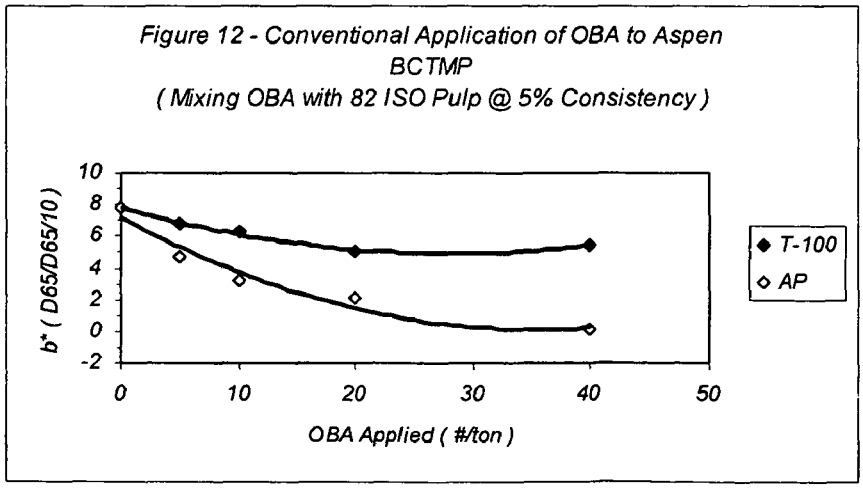
Figure 12 - Conventional Application of OBA to Aspen BCTMP
( Mixing OBA with 82 ISO Pulp @ 5% Consistency )
b* ( D65/D65/10 )
10
8
6
4
2
0
-2
0
10
20
30
40
50
OBA Applied ( #/ton )
T-100
AP

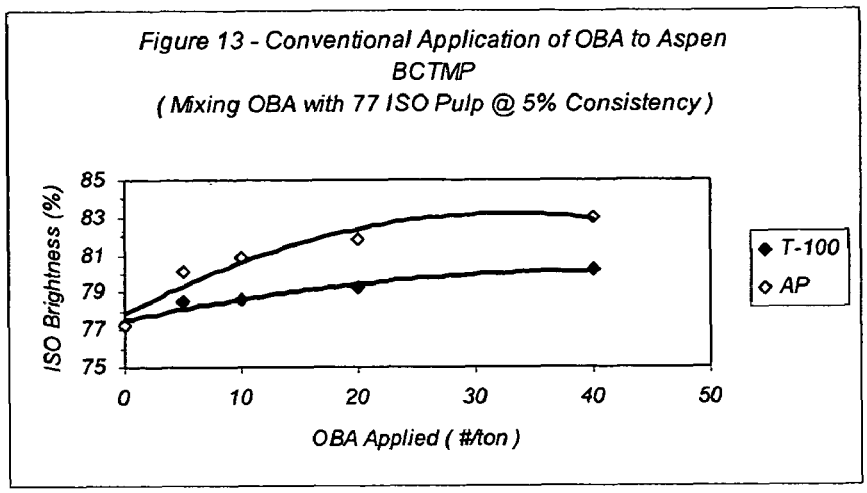
Figure 13 - Conventional Application of OBA to Aspen BCTMP
( Mixing OBA with 77 ISO Pulp @ 5% Consistency )
ISO Brightness (%)
85
83
81
79
77
75
0
10
20
30
40
50
OBA Applied ( #/ton )
T-100
AP

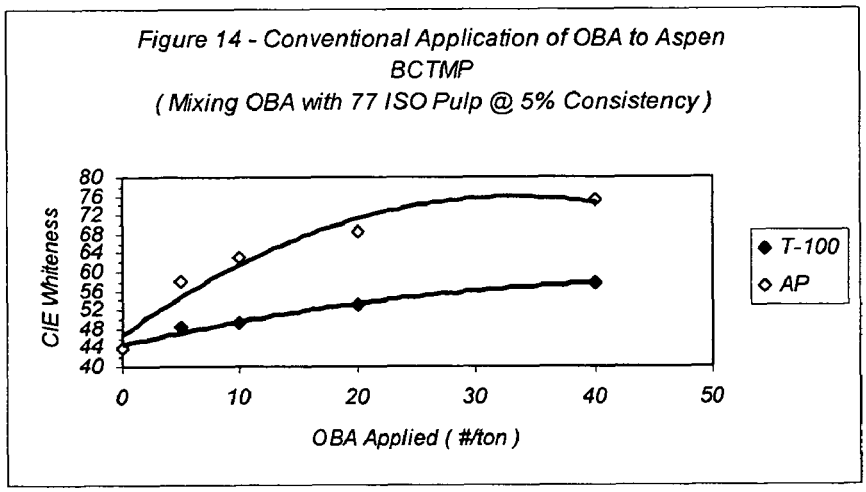
Figure 14 - Conventional Application of OBA to Aspen BCTMP
( Mixing OBA with 77 ISO Pulp @ 5% Consistency )
CIE Whiteness
80
76
72
68
64
60
56
52
48
44
40
0
10
20
30
40
50
OBA Applied ( #/ton )
T-100
AP

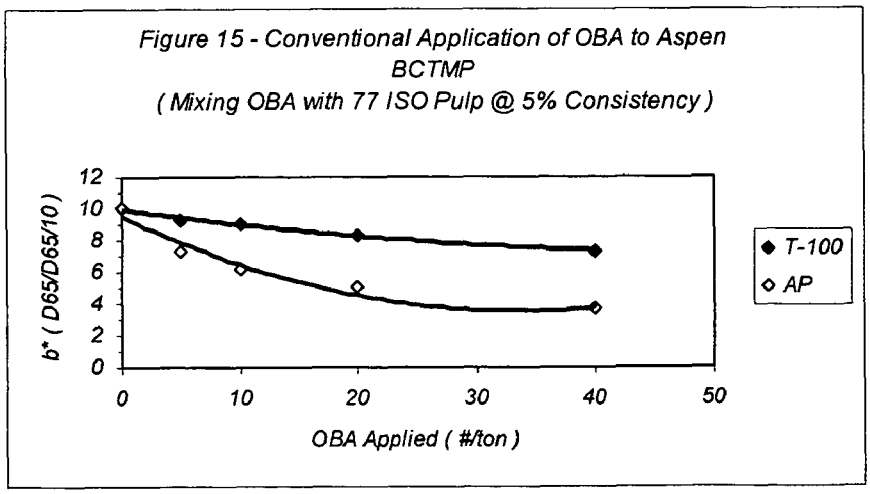
Figure 15 - Conventional Application of OBA to Aspen BCTMP
( Mixing OBA with 77 ISO Pulp @ 5% Consistency )
b* ( D65/D65/10 )
12
10
8
6
4
2
0
0
10
20
30
40
50
OBA Applied ( #/ton )
T-100
AP

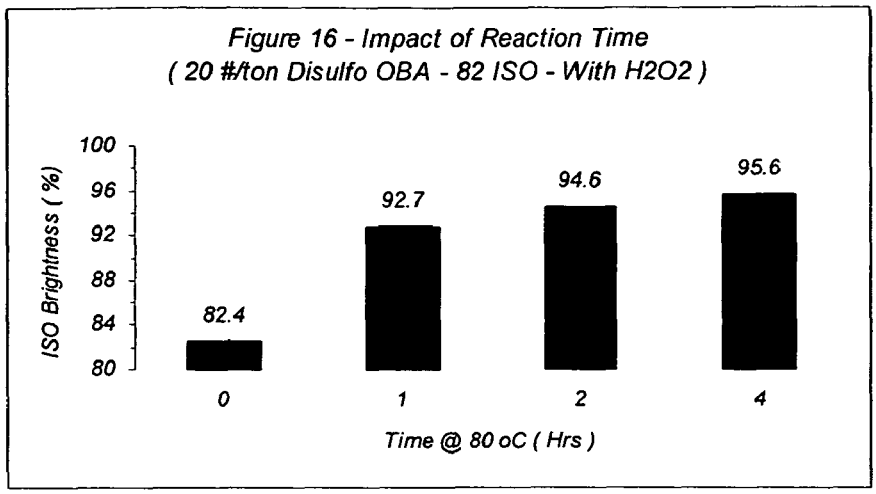
Figure 16 - Impact of Reaction Time
( 20 #/ton Disulfo OBA - 82 ISO - With H2O2 )
ISO Brightness ( %)
100
96
92
88
84
80
82.4
92.7
94.6
95.6
0
1
2
4
Time @ 80 oC ( Hrs )
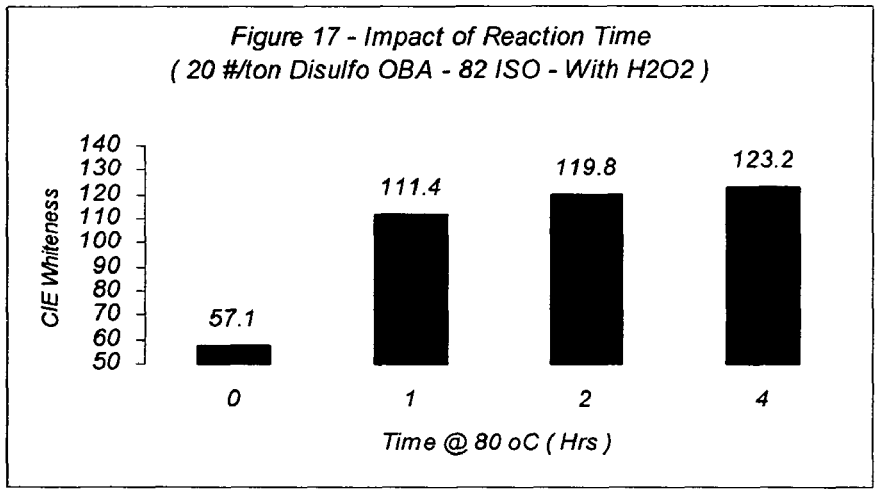
Figure 17 - Impact of Reaction Time
( 20 #/ton Disulfo OBA - 82 ISO - With H2O2 )
CIE Whiteness
140
130
120
110
100
90
80
70
60
50
57.1
111.4
119.8
123.2
0
1
2
4
Time @ 80 oC ( Hrs )
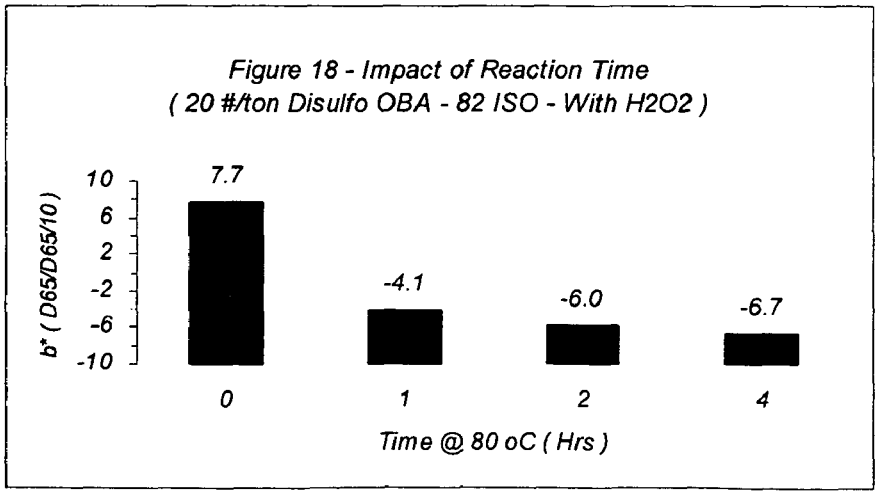
Figure 18 - Impact of Reaction Time
( 20 #/ton Disulfo OBA - 82 ISO - With H2O2 )
b* ( D65/D65/10 )
10
6
2
-2
-6
-10
7.7
-4.1
-6.0
-6.7
0
1
2
4
Time @ 80 oC ( Hrs )

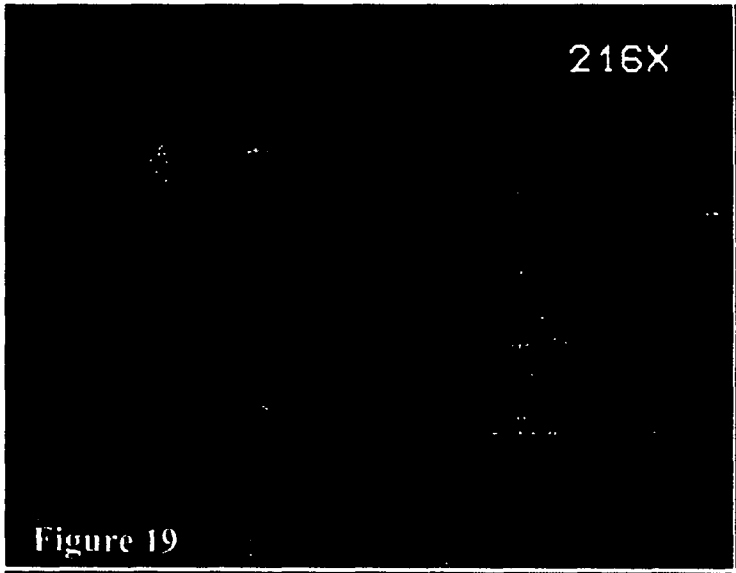
Figure 19
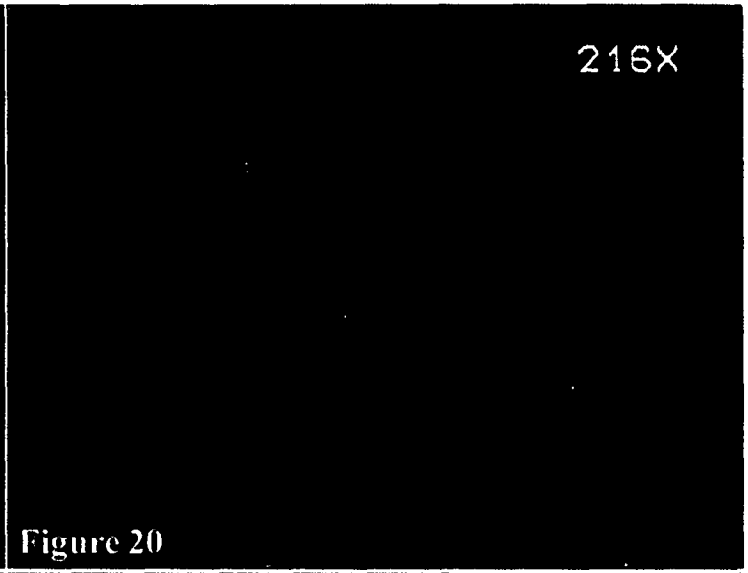
Figure 20
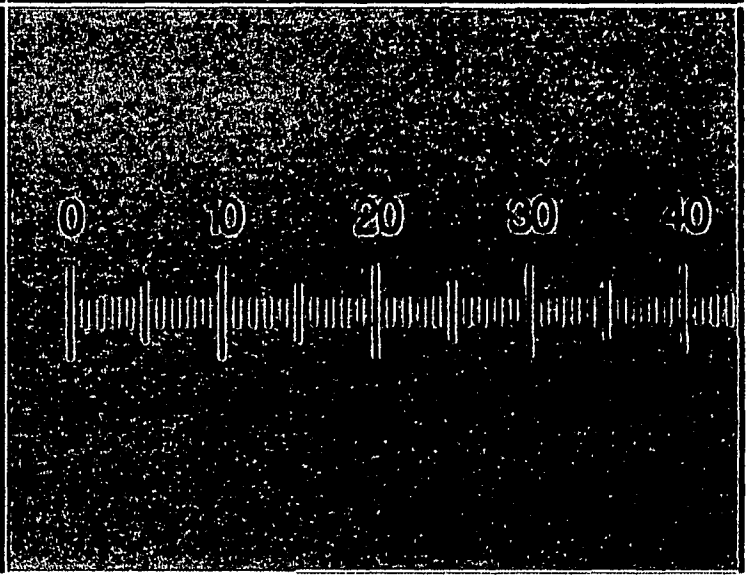
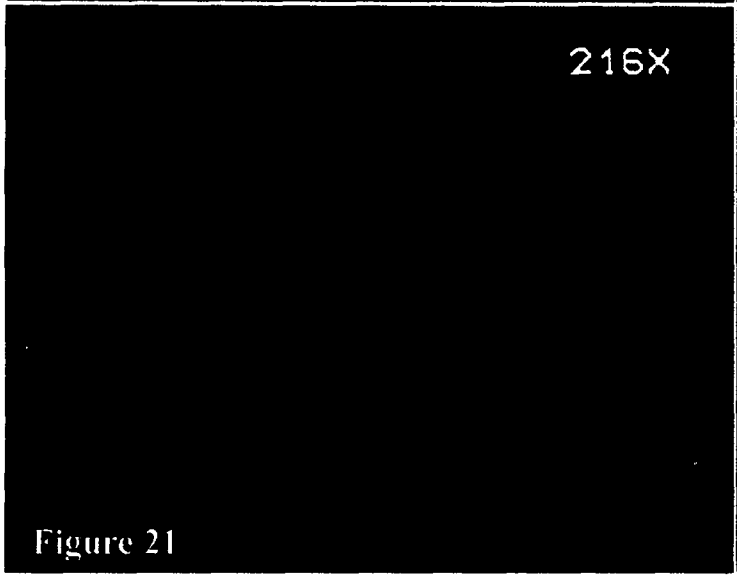
Figure 21

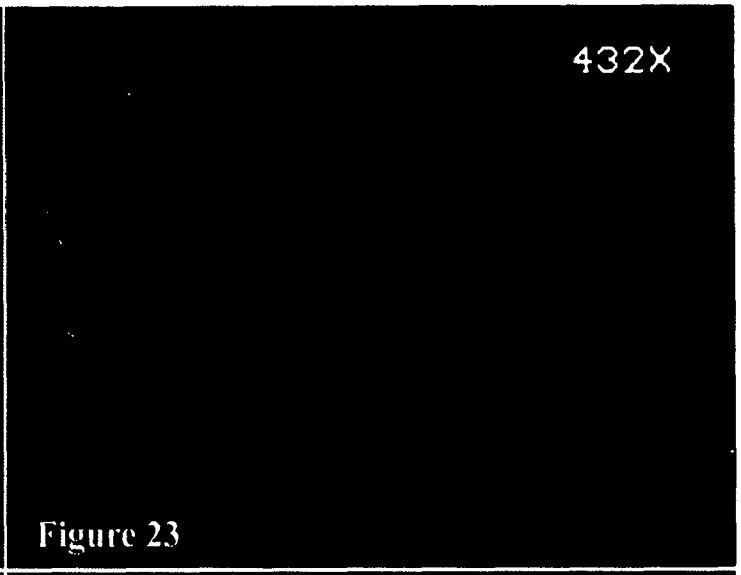
Figure 22
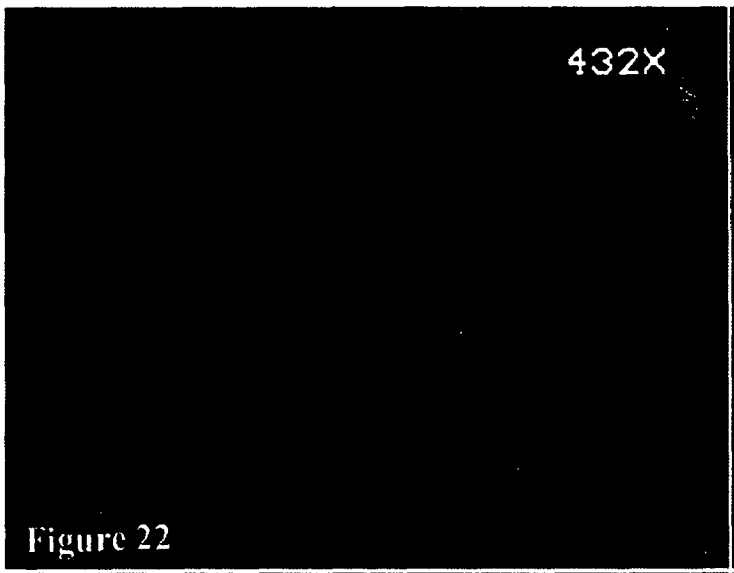
Figure 23
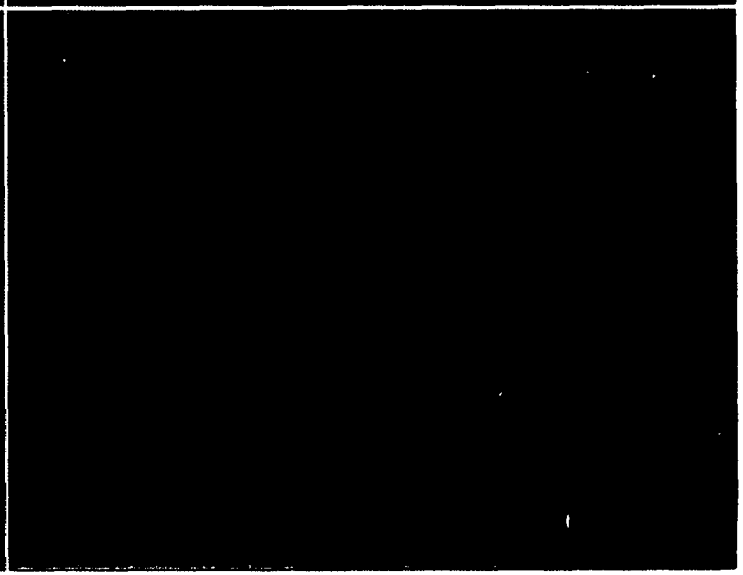
Figure 24
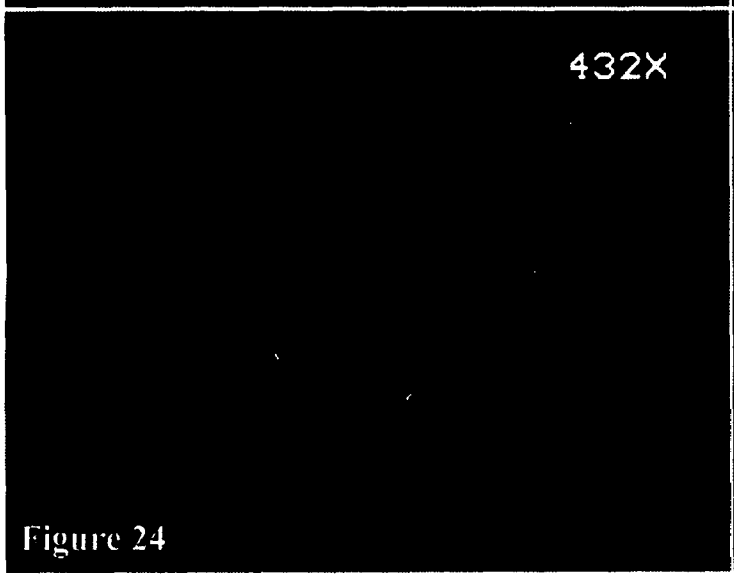

PROCESS FOR NON-CHLORINE OXIDATIVE BLEACHING OF MECHANICAL PULP IN THE PRESENCE OF OPTICAL BRIGHTENING AGENTS

FIELD OF THE INVENTION

This invention relates to an improved method for manufacturing pulp, pulp manufactured in accordance with this process and paper and paperboard products manufactured from the pulp of this invention. More particularly, this invention relates to improvements in processes for the treatment of mechanical pulp with one or more optical brightening agents in the presence of bleaching agents other than chlorine based bleaching agents or in the presence of spent bleaching agents other than chlorine based bleaching agents.

BACKGROUND OF THE INVENTION

Mechanical pulps and processes for manufacturing mechanical pulps are known. See for example U.S. Pat. Nos. 6,527,914; 6,743,332; 5,129,987; 3,388,037; 3,467,574; 3,804,944; 3,985,674; 4,534,954; 4,676,961; 4,756,799; 4,235,665; 4,136,831; 4,012,279; 3,847,363; 3,661,320; 3,873,412 and the like.

The first step in the Mechanical pulping process is the grinding or refining of wood. The Stone Ground wood (SGW) process involves making pulp by pressing logs and chips against an abrasive rotating surface. Many years ago the grinding surface used was an actual stone. In current practice specifically designed "artificial pulp stones" are available for the grinding. A Pressurized Ground Wood (PGW) process is where the grinding operation is completely pressurized.

Another type of Mechanical pulping is Refiner Mechanical Pulp (RMP) featuring atmospheric refining with no pretreatment of the wood chips. This process is one of the main mechanical pulping operations.

Thermo Mechanical Pulping (TMP) is a Mechanical pulping process that evolved from RMP and a high temperature process known as the Apslund process. Thermo Refiner Mechanical Pulping (TRMP) is a variation in Thermo Mechanical Pulping. In this case, the chips are preheated under pressure and refining is carried out at atmospheric pressure. TMP and TRMP pulps are stronger than either SCW or RMP pulps.

The third type of pulping process is a Combination of Chemical and Mechanical pulping processes. Two types of Combination processes are ChemiMechanical Pulping and SemiMechanical Pulping. There is little difference between ChemiMechanical Pulping (CMP) and SemiChemical Mechanical Pulping (SCMP). Both processes involve pretreatment of chips with chemicals, followed by mechanical refining. Four different chemical treatments are associated with these processes. These chemical treatments are: sodium hydroxide, sodium bisulfite, sodium sulfite, and acid sulfite treatment. These processes are generally used on hardwoods. Chemical treatment weakens the fiber structure allowing fibers to rupture similarly to softwood that is mechanically pulped.

ChemiThermoMechanical Pulping (CTMP) appears to be a full evolution of all Mechanical pulping methods. It includes chemical treatment at elevated temperature steaming followed by mechanical refining. This process can produce fibrous raw materials that vary considerably in properties depending upon process conditions such as wood source, sodium sulfite concentration, pH, temperature, etc.

The foregoing list is by no means exhaustive. There are innumerable combinations and variants of the pulping processes as exemplified in The Handbook of Pulping and Papermaking, 2d ed., by Christopher J. Biermann; Acronyms for mechanical Pulp: Understanding the Alphabet Soup, *TAPPI Journal* (December 1987), Cooper, W and Kurdin, J. A.; Leask, R. A. and Kocurek, M. J. (Editors). Mechanical Pulping (Volume 2 of Pulp and Paper Manufacture Series) Joint Textbook Committee, 1987; and Cropp, H. V., Efficient Use of Recovered Energy is a key Mechanical Pulping Goal, Pulp & Paper (April 1991), all of which are herein incorporated by reference.

In general, while having higher yields, opacities and bulk as compared to chemical pulping processes such as Kraft and Sulfite pulping processes, mechanical pulps have a relative low ISO brightness as for example a brightness of not more than 65 ISO units for hardwood mechanical pulps and a brightness of nor more than 60 ISO brightness units for softwood mechanical pulps because of the substantial amounts of retained lignin. To enhance the brightness of mechanical pulp, such pulp has been subjected to one or more subsequent bleaching stages. For example, mechanical pulp resulting from a ChemiThermoMechanical Pulping (CTMP) process can be subjected to one or more subsequent bleaching stages to form Bleached Chemical Thermomechanical Pulp (BCTMP).

Bleaching is a term applied to a semi-chemical or chemical step in a in which the mechanical pulp is treated with an active bleaching agent, such as chlorine, chlorine dioxide, ozone, oxygen, hydrogen peroxide, peroxy acids, enzymes, or a mixture thereof, at a controlled time, temperature, and pH. The desired outcome of these reactions is to brighten the mechanical pulp to ever-higher levels of brightness (the Technical Association of the Pulp & Paper Industry ("TAPPI") or the International Organization for Standardization ("ISO")). Brightness levels can be increased to some extent. For example, the ISO brightness of softwood mechanical pulps can be increased to about 75 ISO with one conventional peroxide bleaching stage and about 80 ISO with two conventional peroxide bleaching stages and the ISO brightness of hardwood mechanical pulps can be increased to about 80 ISO with one peroxide bleaching stage and about 85 ISO with two conventional peroxide bleaching stages. Widespread consumer preference for a brighter, whiter pulp drives manufacturers to pursue ever more aggressive bleaching strategies. However, while brightness levels are increased somewhat, other properties of the mechanical pulp are adversely impacted such as bulk and opacity which increases with increasing bleaching. While highly bleached pulps are "whiter" than their less-bleached cousins, they are still yellow-white in color. A yellow-white product is undesirable. Countless studies suggest that consumers clearly favor a blue-white over a yellow-white color. The former is perceived to be whiter, i.e., "fresh", "new" and "clean", while the latter is judged to be "old", "faded", and "dirty".

Further optical enhancement in brightness is usually accomplished by the addition of tinting colorants, fillers, and/or Fluorescent whitening agents (FWA) or optical brightening agents (OBA) usually added during the stage during which the pulp is mixed with A optical brightening agents and processes for enhancing the brightness pulp or paper fibers are described in U.S. Pat. Nos. 5,482,514; 6,893,473; 6,723,846; 6,890,454; 6,426,382; 4,169,810; 5,902,454; and U.S. Pat. Application Publication Nos. US 2004/014910 and US 2003/0013628.

SUMMARY OF THE INVENTION

One aspect of this invention relates to an improved process for treating mechanical pulp comprising treating the pulp with one or more optical brightening agents in the presence of bleaching agents other than chlorine based bleaching agents or in the presence of spent bleaching agents other than chlorine based bleaching agents. The treatment is preferably carried out during a bleaching stage. The bleaching agents are selected from the group consisting of oxidative bleaching agents other than chlorine based bleaching agents such as chlorine dioxide, elemental chlorine or a combination thereof, reductive bleaching agents or any combination of two or more thereof. The process of the present invention provides for one or more advantages over prior processes for brightening bleached and/or unbleached mechanical pulps. For example, advantages of some of the embodiments of the process of this invention include mechanical pulp having high ISO brightness levels and/or CIE Whiteness levels. In certain embodiments, lower amounts of bleach chemicals can be used to attain ISO brightness levels and/or CE Whiteness levels as compared to conventional processes. In still other embodiments of the invention, high ISO brightness levels and/or CIE Whiteness levels can be obtained without adversely impacting mechanical pulp bulk and/or opacity unduly. Some embodiments of this invention may exhibit one of the aforementioned advantages while other preferred embodiments may exhibit two or more of the foregoing advantages in any combination.

Another aspect of this invention relates to brightened mechanical pulp having a brightness equal to or greater than 90 ISO and pulp mixtures comprising such mechanical pulp. Still another aspect of this invention relates to bleached mechanical pulp having brightness increased by from about 5 to about 10 ISO units greater than brightness levels of conventional bleached mechanical pulps while not adversely impact the bulk or opacity properties of the pulp to an undue extent.

Still another aspect of this invention relates to an improved process for forming bleached mechanical pulp of the type comprising:

(a) a mechanical refining stage wherein wood chips are mechanically refined to form mechanical refined wood pulp; and (b) a bleaching stage wherein said mechanical refined wood pulp is bleached in one or more bleaching stages to form a bleached mechanical refined wood pulp;

the improvement comprising bleaching the mechanical refined wood pulp with one or more bleaching agents in the presence of one or more optical brightening agent, said bleaching agents selected from the group consisting of oxidative bleaching agents other than chlorine based bleaching agents such as chlorine dioxide, elemental chlorine or a combination thereof, reductive bleaching agents or any combination of two or more thereof.

Yet another aspect of this invention relates to an improved pulping and paper making process of the type comprising:

(a) a mechanical refining stage wherein wood chips are mechanically refined to form mechanical refined wood pulp, (b) a bleaching stage wherein said mechanically refined wood pulp is bleached in one or more bleaching stages to form bleached mechanical refined aspen wood pulp, (c) a furnish forming stage wherein an aqueous paper making stock furnish comprising said bleached mechanical refined wood pulp is formed;

(d) a furnish depositing stage wherein said furnish is deposited on a forming wire of a paper making machine to form a wet paper web; and (e) a wet paper web drying stage wherein said wet paper web to form a first dried paper web, the improvement comprising bleaching the mechanical refined wood pulp with one or more bleaching agents in the presence of one or more optical brightening agents, said bleaching agents selected from the group consisting of oxidative bleaching agents other than chlorine based bleaching agents such as chlorine dioxide, elemental chlorine or a combination thereof, reductive bleaching agents or any combination of two or more thereof.

Still another aspect of this invention relates to the paper web comprising bleached mechanical pulp having an ISO brightness equal to or greater than about 90, said pulp preferably having a bulk equal to or greater than about 2 cm^3/g and an opacity equal to or greater than about 79% and pulp mixtures comprising such mechanical pulp.

BRIEF DESCRIPTION OF THE DRAWINGS

In the drawings:

FIGS. 1 to 3 are graphs, illustrating improvement in the ISO brightness, CIE Whiteness and yellow shade b* value, when the invention was practice with disulfonated stilbene based OBA obtained from Clariant under the tradename Leucophor AP and was applied to Aspen BCTMP which had gone through the first hydrogen peroxide bleaching stage to the first stage brightness targets of 73 ISO, 77 ISO and 82 ISO.

FIGS. 4 to 6 are graphs, illustrating improvement in ISO brightness, CIE Whiteness and yellow shade b* value, when the invention was applied to Aspen BCTMP which was bleached in the first hydrogen peroxide stage to the first stage brightness target of 82 ISO and when the invention was practiced using Leucophor AP or tetra sulfo stilbene based OBA obtained from Clariant under the tradename Leucophor T-100.

FIGS. 7 to 9 are graphs, illustrating improvement in ISO brightness, CIE Whiteness and yellow shade b* value, when the invention was applied to Aspen BCTMP which was bleached in the first hydrogen peroxide stage to the first stage brightness target of 77 ISO and when the invention was practice with either a simultaneous mixing of Leucophor AP with all bleaching chemicals at the beginning of the peroxide bleaching or with a sequential mixing of OBA with pulp at the end of the peroxide bleaching stage but before the pulp washing.

FIGS. 10 to 12 are comparative graphs, showing comparative improvement in ISO brightness, CIE Whiteness and yellow shade b* value, when the prior art of mixing OBA with pulp was practiced on an 82 ISO Aspen BCTMP and when either Leucophor AP or Leucophor T-100 was used.

FIGS. 13 to 15 are comparative graphs, similar to FIGS. 10-12 but for the case of 77 ISO Aspen BCTMP.

FIGS. 16 to 18 are graphs, illustrating improvement in ISO brightness, CE Whiteness and yellow shade b* value, when the invention was applied to 82 ISO Aspen BCTMP and when the reaction time of the invention was varied from 1 hour to 4 hours.

FIGS. 19 to 24 are photomicrographs pulp fibers treated with OBA in accordance with the process of this invention and pulp fibers treated with OBA in the absence of active and spent bleaching chemicals.

DETAILED DESCRIPTION OF THE INVENTION

The process of this invention is an improvement in those processes of treating mechanical pulp with optical brightening agents to increase pulp brightness and/or whiteness. In the present invention, pulp is treated with one or more optical brightening agents in the presence of one or more bleaching agent selected from the group consisting of bleaching agents other than chlorine based bleaching agents. In the preferred embodiments of this invention, the bleaching agents may be active in which case the optical brightening agent can be added during one or more bleaching stages with one or more suitable bleaching agents. Order and point of addition of the optical brightening agent and the bleaching agent to the treating mixture are not critical. For example, the optical brightening agent can be added prior to the addition of bleaching agent and/or other bleaching chemicals, with one or more of the bleaching agent and/or other bleaching chemicals, after the initial addition of the bleaching agent and/or other bleaching chemicals, at any time during bleaching and at any time after the completion of the bleaching process in the presence of the spent bleaching agent. The optical brightening agent is preferably added in admixture with the bleaching agent and/or one or more other bleaching chemicals.

The plant source of mechanical pulp for use in this invention is not critical and may be any fibrous plant which can be subjected to mechanical pulping. Examples of such fibrous plants are trees, including hardwood fibrous trees such as aspen, eucalyptus, maple, birch, walnut, acacia and softwood fibrous trees such as spruce, pine, cedar, including mixtures thereof. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. The source of mechanical pulp for use in the practice of this invention is preferably hardwood and softwood fibrous trees, more preferably Eucalyptus, Spruce and Aspen and is most preferably Aspen and Spruce.

The mechanical pulp used in the process of this invention can obtained by subjecting the fibrous plant to any mechanical pulping process in which the fibrous plant is mechanically triturating wood into its fibers for the purpose of making pulp. There are many variants of mechanical pulping which can be used make the mechanical pulp used in the process of this invention. Illustrative of such mechanical pulping processes are those described in *The Handbook of Pulping and Papermaking,* 2d ed., by Christopher J. Biermann; Acronyms for mechanical Pulp: Understanding the Alphabet Soup; *TAPPI Journal* (December 1987), Cooper, W and Kurdin, J. A.; Leask, R. A. and Kocurek, M. J. (Editors) Mechanical Pulping (Volume 2 of Pulp and Paper Manufacture Series) Joint Textbook Committee, 1987; and Cropp, H. V., Efficient Use of Recovered Energy is a key Mechanical Pulping Goal, Pulp & Paper (April 1991), "Handbook For Pulp & Paper Technologies", 2$^{nd}$ Edition, G. A. Smook, Angus Wilde Publications (1992) and references cited therein, all of which are herein incorporated by reference. Such methods include stone grinding (SG), pressurized stone grinding (PSG), refiner mechanical pulping (RMP), thermo mechanical pulping (TMP), chemi-thermomechanical pulping (CTMP), bleached chemi-thermomechanical pulping (BCTMP) and the like. Preferred for use in the practice of this invention is mechanical pulp made by thermo mechanical pulping (TMP), chemi-thermomechanical pulping (CTMP) and bleached chemi-thermomechanical pulping (BCTMP) processes. More preferably the pulp is made by chemi-thermomechanical pulping (CTMP) and bleached chemi-thermomechanical pulping (BCTMP) processes and most preferably by bleached chemi-thermomechanical pulping (BCTMP) processes.

The bleaching consistency may vary widely and any consistency that provides the desired increase in pulp brightness may be used. The mechanical pulp may be bleached under low consistency conditions (i.e. from about 3% to about 6% based on the total weight of the mixture of pulp and bleaching chemicals), medium consistency conditions (i.e. from about 8% to about 14% based on the total weight of the mixture of pulp and bleaching chemicals) or high consistency conditions (i.e. from about 20% to about 30% based on the total weight of the mixture of pulp and bleaching chemicals). The consistency is preferably 10%, more preferably 14% and most preferably 25%.

Optical brightening agents ("OBAs") used in the practice of the process of this invention may vary widely and any conventional OBA used or which can be used to brighten mechanical or Kraft pulp can be used in the conduct of the process of this invention. Optical brighteners are dye-like fluorescent compounds are substances that absorb light in the invisible ultraviolet region of the spectrum and reemit it in the visible portion of the spectrum, particularly in the blue to blue violet wavelengths. This provides added brightness and can offset the natural yellow cast of a substrate such as paper. Optical brighteners used in the present invention may vary widely and any suitable optical brightener may be used. An overview of such brighteners is to be found, for example, in Ullmann's Encyclopedia of Industrial Chemistry, Sixth Edition, 2000 Electronic Release, OPTICAL BRIGHTENERS—Chemistry of Technical Products which is hereby incorporated, in its entirety, herein by reference. Other useful optical brighteners are described in U.S. Pat. Nos. 5,902,454; 6,723,846; 6,890,454; 5,482,514; 6,893,473; 6,723,846; 6,890,454; 6,426,382; 4,169,810; and 5,902,454 and references cited therein which are all incorporated by reference. Still other useful optical brighteners are described in; and U.S. Pat. Application Publication Nos. US 2004/014910 and US 2003/0013628; and WO 96/00221 and references cited therein which are all incorporated by reference. Illustrative of useful optical brighteners are 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides.

Most commercially available optical brightening agents are based on stilbene, coumarin and pyrazoline chemistries and these are preferred for use in the practice of this invention. More preferred optical brighteners for use in the practice of this invention are optical brighteners typically used in the paper industry based on stilbene chemistry such as 1,3,5-triazinyl derivatives of 4,4'-diaminostilbene-2,2'-disulfonic acid and salts thereof, which may carry additional sulfo groups, as for example at the 2, 4 and/or 6 positions. Most preferred are the commercially available stilbene derivatives as for example those commercially available from Ciba Geigy under the tradename "Tinopal", from Clariant under the tradename "Leucophor", from Lanxess under the tradename "Blankophor", and from 3V under the tradename "Optiblanc" such as disulfonate, tetrasulfonate and hexasulfonate stilbene based optical brightening agents. Of these most preferred commercial optical brightening agents, the commercially available disulfonate and tetra sulfonate stilbene based optical brightening agents are more preferred and the commercially available disulfonate stilbene based optical brightening agents is most preferred.

The amount of optical brightener used in the practice of the process of this invention can vary widely and any amount sufficient to provide the desired degree of brightness can be used. In general, the lesser the amount of optical brightener employed the less the enhancement in ISO brightness of the final pulp product. Conversely, the greater the amount of optical brightener used the greater the enhancement in pulp brightness except that while we do not wish to be bound by any theory, it is believe that at some point the addition of more optical brightener will not have any further appreciable impact on pulp brightness and may even result in a decrease in pulp brightness. The amount of optical brightener used is usually at least about 0.1% based on the dry weight of the pulp. Preferably the amount of optical brightener is from about 0.1% to about 2%, more preferably from about 0.3% to about 1.5% and most preferably from about 0.5% to about 1% on the aforementioned basis.

Any oxidative bleaching other than a chlorine based bleaching agent can be used in the practice of this invention and any reductive bleaching agent can be used. Suitable bleaching agents are described in "The Bleaching of Pulp" 3rd Ed. RP. Singh, TAPPI PRESS, Atlanta, Ga. 1979. Illustrative of suitable oxidative bleaching agents are oxygen, peroxides and per-oxy acids or acid derivatives of hydrogen peroxide such as peroxymono sulfuric acid and peroxyacetic acid, dimethyl dioxirane. However, besides pulp brightness improvement, the use of these peroxy acids on mechanical pulps could result in undesirable side effects such as yield loss through dissolution and removal or lignin and some decomposition of OBA chemicals. Such undesirable effects can be minimized through delaying the mixing OBA with pulp toward the later part of the bleaching stage, after most of bleaching chemicals was consumed. Illustrative reducing bleaching agents are sodium hydrosulfite, sodium bisulfite and zinc hydrosulfite. To minimize the lignin removal and yield loss and undesirable decomposition of OBA, peroxides are therefore the most preferred bleaching agents.

The amount of bleaching agent used in the practice of the process of this invention can vary widely and any amount sufficient to provide the desired degree of brightness can be used. In general, the lesser the amount of bleaching agent employed the less the enhancement in ISO brightness of the final pulp product. Conversely, the greater the amount of bleaching agent used the greater the enhancement in pulp brightness except that the greater the amount of bleaching agent employed the greater the reduction in the bulk and porosity of the bleached mechanical pulp product. The amount of bleaching agent used is usually at least about 1% based on the dry weight of the pulp. Preferably the amount of bleaching agent is from about 1% to about 8%, more preferably from about 2% to about 6% and most preferably from about 3% to about 5% on the aforementioned basis.

In the most preferred embodiments of the invention when hydrogen peroxide is the bleaching agent, the amount of hydrogen peroxide in the bleaching liquor is preferably from about 10 to about 200 pounds per ton of pulp on a dry basis. The hydrogen peroxide is conventionally obtained from suppliers as a mixture of 60% water and 40% hydrogen peroxide on a weight basis, but other proportions of water and hydrogen peroxide can be used, provided they are equivalent to 10 to 200 pounds of a 60:40 mixture. An acceptable ratio of alkalinity to hydrogen peroxide is about 0.25 to about 3 on a weight basis of the 60:40 mixtures. These amounts of hydrogen peroxide can be applied to the methods of brightening mechanical pulps according to the present invention.

The bleaching liquor can also contain various optional components which stabilize the bleaching agent under bleaching conditions and do so in the preferred embodiments of the invention. The particular stabilizer used will depend on the bleaching agent employed and any conventional stabilizer can be used in the practice of the invention. For example useful stabilizers include but are not limited to silicates such as sodium silicate and chelating agents, such as, but not limited to aminopolycarboxylic acids (APCA), ethylenediaminetetraacetic acid (EDTA), diethylene triamine pentaacetic acid (DTPA), nitrilotriacetic acid (NTA), phosphonic acids, ethylenediaminetetramethylene-phosphonic acid (EDTMP), diethylenetriaminepentamethylenephosphonic acid (DTPMP), nitrilotrimethylenephosphonic acid (NTMP), polycarboxylic acids, gluconates, citrates, polyacrylates, and polyaspartates or any combination thereof. Mixtures of thermodynamic and kinetic controlling chelating agents (e.g. citrates, keto acids, gluconates, heptagluconates, phosphates, and phosphonates) also work well in reducing the content of free heavy metal ions in the paper to acceptable levels. Kinetic controlling chelating agents are those which do not form a stable, isolable, complex with a heavy metal ion. In the most preferred embodiments of the invention where hydrogen peroxide is the bleaching agent silicates preferably sodium silicate and a chelating agent preferably diethylene triamine pentaacetic acid (DTPA) are used. Reference is made to the following articles for detailed descriptions of the chemical activity provided by stabilizers such as chelating agents and silicates: Pulp Bleaching: Principles and Practice, by Carlton W. Dence and Douglas W. Reeve, Tappi Press, Technology Park, PO Box 105113, Atlanta, Ga. (1996) and V. N. Gupta, Pulp Paper Mag. Can., 71 (18), T391-399 (1970, which are herein incorporated by reference.

Any amount of these optional components can be used for the desired effect and usually conventional amounts are employed. For example, each stabilizer can be present in an amount of up to about 10% by weight.

In addition to stabilizers such as silicates and chelating agents, the bleaching liquor can also include bleaching aids in amounts of up to 10% by weight. Bleaching aids further enhance the bleaching activity. Bleaching aids include adjuvants such as Chip Aid® and HP Booster supplied from Constant Labs of Montreal, Canada. Adjuvants such as chelating agents and bleaching aids can be applied to the method of brightening mechanical pulps according to the invention.

The composition of the bleaching liquor has been described as a mixture. However, it should be readily apparent that the components of the bleach liquor can be added separately or in mixtures of any combination in any order.

Bleaching times will vary widely and conventional bleaching times may be used. As is known in the art, bleaching times will usually depend upon available process equipment, production rates, temperatures, pulp, bleach chemicals, end pH, and other bleaching conditions. Usually, bleaching times will be at least about 20 minutes. Bleaching times are preferably from about 30 minutes to about 6 hours, and are more preferably from about 60 minutes to about 4 hours and most preferably from about 90 minutes to about 2 hours Similarly, bleaching temperatures employed in the critical bleaching stage may vary widely and temperatures employed in conventional bleaching stages may be used. For example, useful temperatures can be as low as about 25° C. or lower and as high as about 100° C. or higher. In the process of this invention, the bleaching temperature is usually from about 25° C. to about 120° C., preferably from about 40° C. to about 100° C., more preferably from about 60° C. to about 90° C. and most preferably from about 70° C. to about 80° C.

The end pH of the bleaching stage may vary widely and can be any value which is normally obtained in conventional bleaching stages with hydrogen based bleaching agents. For example, the end pH can be as high as about 11 and higher and as low as about 7 and lower. In the preferred embodiments of the invention, the end pH is equal to or greater than about 7.0, in the more preferred embodiments of the invention is from about 7 to about 10, and in the most preferred embodiments of the invention is from about 8 to about 9.

The beginning pH of the bleaching stage may vary widely and can be any value which is normally obtained in conventional bleaching stages with chlorine-based bleaching agents. For example, the beginning pH can be as high as about 12 and as low as about 9. In the preferred embodiments of the invention, the beginning pH is equal to or higher than about 10 and in the more preferred embodiments of the invention is from about 10 to about 11.

Bleaching pH can be controlled using materials used in conventional bleaching processes in conventional amounts. For example, where the bleaching agent is peroxide pH can be controlled through use of an alkali buffer such as soda ash, magnesium hydroxide or the like, or by the addition of an organic or inorganic base such as sodium hydroxide, ammonia, ammonium hydroxide, potassium hydroxide or the like.

In this invention, the mechanical pulp can be bleached in a single bleaching stage or can be bleached in more than one bleaching stage. In each instance, the brightness of the pulp will be greater than the brightness of the mechanical pulp bleached under the same conditions except that no optical brightener is added to the bleaching stage. While pulp brightness increases with the number of bleaching stages, other important properties of the pulp such as bulk and opacity decrease. Accordingly, the number of bleaching stages can be varied to optimize the brightness, bulk and opacity properties of the bleached pulp consistent with the desire use of the pulp.

The types of bleaching sequences and the number and type of bleaching stages comprising the sequences may vary widely provided that the essential bleaching stage with one or more optical brighteners and one or more oxidative or reductive bleaching agents other than a chlorine based bleaching agent is present. In the preferred embodiment of this invention, the bleaching process of this invention comprises one or two stages.

Certain bleached mechanical pulps of this invention exhibit superior ISO brightness as determined by the standard TAPPI T452 om-02 test method, especially as compared to mechanical pulp bleached under the same conditions but excluding the optical brightener. In these embodiments, the incremental increase in the ISO brightness of the pulp, as a result of optical brightener addition is usually at least about 2 ISO points. The incremental brightness increase of the pulp is preferably at least about 4 ISO points, more preferably from about 6 ISO points to about 8 ISO points and most preferably from about 9 ISO points to about 11 ISO points.

Other bleached mechanical pulps of this invention exhibit relatively high ISO brightness and because of the enhanced bleaching efficiency also exhibit relatively high bulk as determined by the standard TAPPI T411 and T452 om-02 testing methods and opacity as determined by the standard TAPPI T519 om-02 test method. In these embodiments, the ISO brightness of the pulp is usually at least about 80 ISO, the bulk is usually equal to or greater than about 1.8 cm^3/g and the opacity is usually equal to or greater than about 78%. The ISO brightness of the pulp is preferably at least about 85 ISO, the bulk is preferably equal to or greater than about 2.2 cm^3/g and the opacity is preferably equal to or greater than about 80%. In the more preferred embodiments, the ISO brightness of the pulp is at least about 90 ISO, the bulk is equal to or greater than about 2.0 cm^3/g and the opacity is equal to or greater than about 78%, and in the most preferred embodiments, the ISO brightness of the pulp is at least about 95 ISO, the bulk is equal to or greater than about 1.9 cm^3/g and the opacity is equal to or greater than about 78%.

The present invention relates in part, to a fiber:OBA complex in which the affinity of the OBA added to the fiber according to present invention is preferably greater than that when the OBA is added to the fiber conventionally. When the OBA is added to the fiber according to the method of the present invention, there is 30 to 60% reduction in the OBA required to be added than that of conventional methods and addition points. The reduction may be 30, 31, 32, 33, 34, 35, 40, 45, 50, 55, 56, 57, 58, 59, and 60% compared to that required in conventional methods and addition points, including any and all ranges and subranges therein.

In addition, the present invention preferably provides increased the penetration of OBA into the cell wall of a mechanical pulp fiber which in these preferred embodiments of the invention is believed to increase affinity of the OBA to the mechanical pulp fiber. Because the OBA has increased affinity to the mechanical pulp fiber overall in the present inventive mechanical pulps and paper substrates made therefrom compared to conventional pulp, it will take a longer period of time for the OBA to be extracted from the mechanical pulp pulp:OBA complex of the present invention (mechanical pulp and/or paper) at a given time period and temperature for a given solvent. The amount of OBA present within the cell wall of mechanical pulp fiber may be measured, for example, by microscopy, more specifically fluorescent microscopy and the affinity of the OBA to the mechanical pulp fiber may be measured by extraction methods using any solvent, preferably water, at any temperature. Preferably, there is a greater amount of OBA that has penetrated the cell wall of a mechanical pulp fiber treated according to the present invention than that of mechanical pulp fibers treated with OBA using conventional methods after bleaching. More preferably, the amount of OBA present within the cell wall of the mechanical pulp fiber is increased by at least 1% more than the amount of OBA present within the cell wall of mechanical pulp fiber that was treated in conventional methods. However, it is more preferred that the amount of OBA present within the cell wall of the mechanical pulp fiber is increased by at least 2, 3, 4, 5, 6, 7, 8, 9, 10, 15, 20, 25, 30, 35, 40, 45, 50, 55, 60, 65, 70, 75, 80, 85, 90, 100, 200, 300, 500, and 1000% than the amount of OBA present within the cell wall of fiber that was treated in conventional methods, including any and all ranges and subranges therein.

More preferably, the amount of the cell wall of the mechanical pulp fiber penetrated by the OBA is at least 1%. However, it is more preferred that the amount of the cell wall of the mechanical pulp fiber penetrated by the OBA is at least 2, 3, 4, 5, 6, 7, 8, 9, 10, 15, 20, 25, 30, 35, 40, 45, 50, 55, 60, 65, 70, 75, 80, 85, 90, or 100 including any and all ranges and subranges therein.

The mechanical pulps of this invention have a wide variety of uses for which pulps can be used. For example, the mechanical pulp can be used to make fluff pulp that can be in the fabrication of absorbent articles such as diapers, feminine hygiene and adult incontinence products, wipes, towels and the like. Illustrative of such absorbent products are those described in U.S. Pat. No. 5,766,159 and U.S. Pat. No. 6,063,982.

The mechanical pulp of this invention can also be used in the manufacture of paper and packaging products such as printing, writing, publication and cover papers and paperboard products. Illustrative of these products and processes for their manufacture are those described in U.S. Pat. Nos. 5,902,454 and 6,464,832.

For example, in the paper or paperboard making process, the bleached mechanical pulp of this invention or pulp mixtures comprising the bleached mechanical pulp of this invention is formulated into an aqueous paper making stock furnish which also comprises one of more additives which impart or enhance specific sheet properties or which control other process parameters. Illustrative of such additives is alum which is used to control pH, fix additives onto pulp fibers and improve retention of the pulp fibers on the paper making machine. Other aluminum based chemicals which may be added to the furnish are sodium aluminate, poly aluminum silicate sulfate and poly aluminum chloride. Other wet end chemicals which may be included in the paper making stock furnish for conventional purposes are acid and bases, sizing agents, dry-strength resins, wet strength resins, fillers, coloring materials, retention aids, fiber flocculants, defoamers, drainage aids, optical brighteners, pitch control chemicals, slimicides, biocides, specialty chemicals such as corrosion inhibitors, flame proofing and anti-tarnish chemicals, and the like. Methods and procedures for formulating mechanical bleached pulp, aluminum based wet end chemicals and other optional wet end chemicals are well known in the art and will not be described in any great detail. See for example, *Pulp and Paper Manufacture Pulp and Paper Chemistry and Pulp Bleaching and Handbook For Pulp & Paper Technologies*, supra.

The aqueous paper making stock furnish comprising the bleached mechanical pulp and the aluminum based compounds is deposited onto the forming wire of a conventional paper making machine to form a wet deposited web of paper or paperboard and the wet deposited web of paper or paperboard is dried to form a dried web of paper or paperboard. Paper making machines and the use of same to make paper are well known in the art and will not be described in any great detail. See for example, *Pulp and Paper Chemistry and Handbook For Pulp & Paper Technologies* supra. By way of example, the aqueous paper making stock furnish containing pulp, aluminum based and other optional additives and usually having a consistency of from about 0.3% to about 1% is deposited from the head box of a suitable paper making machine as for example a twin or single wire Fourdrinier machine. The deposited paper making stock furnish is dewatered by vacuum in the forming section. The dewatered furnish is conveyed from the forming section to the press section on specially-constructed felts through a series of roll press nips which removes water and consolidates the wet web of paper and thereafter to the dryer section where the wet web of paper is dried to form the dried web of paper of this invention. After drying, the dried web of paper may be optionally subjected to several dry end operations such as and various surface treatments such as coating, and sizing and calendering.

The paper manufactured in accordance with this invention can be used for conventional purposes. For example, the paper is useful as printing paper, publication paper, newsprint and the like.

The present invention is described in more detail by referring to the following examples and comparative examples which are intended to more practically illustrate the invention and not to be a limitation thereon.

Examples 1A to 10 D and Comparative Examples C1 to C34

A series of experiments were carried out to demonstrate the invention in detail. One purpose of these experiments is to demonstrate the effect of treatment time, temperature, consistency and chemical additives (OBA, $H_2O_2$, $Na_2SiO_3$, DTPA) on the ISO brightness and the CIE Whiteness of the treated Aspen BCTMP pulp. In these experiments, distill/deionize water was added to the starting Aspen BCTMP pulp having a starting ISO brightness and CIE whiteness to form a slurry having the desired pulp consistency target. Bleach chemical solutions containing the desired amounts of $H_2O_2$, NaOH and optionally chelating and stabilization chemicals were prepared. OBA is added to the bleach solution in those experiments in which OBA is a component of the bleach composition to demonstrate the invention. The various bleach solutions (those with and without OBA) were well mixed with the starting pulp. The mixture was then sealed in a plastic bag and the sealed plastic bag placed into a temperature bath containing water, which was preset and controlled to a constant temperature target. The sealed plastic bag was kept in the bath for the predetermined time duration, after which the bag was opened and the pulp washed with distill/deionize water. The ISO brightness of the washed pulp was determined by the procedure of TAPPI T452 Test Method and the CIE Whiteness of the washed pulp was determined by the standard CEILAB coordinates.

The specific process conditions and the results of the evaluation are set forth in the following Table I and in FIGS. 1 through 18.

TABLE I

| | Aspen BCTMP | | | | | | | | | | | | | | | |
|---|---|---|---|---|---|---|---|---|---|---|---|---|---|---|---|---|
| Ex No. | $H_2O_2$ (%) | NaOH (%) | $Na_2SiO_3$ (%) | [1]DTPA (%) | $MgSO_4$ (%) | [2]AP (#/ton) | [3]T (#/ton) | [4]C (%) | Time hrs | T° C. | Initial pH | Final pH | Final ISO | Final CIE | Initial ISO | Initial CIE |
| C1 | 6 | 5 | 3 | 0.5 | 0.5 | 0 | | 20 | 3 | 85 | 11.0 | 9.0 | 84.6 | 62.7 | 73.1 | 32.2 |
| 1A | 6 | 5 | 3 | 0.5 | 0.5 | 5 | | 20 | 3 | 85 | 11.0 | 9.3 | 89.9 | 93.4 | 73.1 | 32.2 |
| 2A | 6 | 5 | 3 | 0.5 | 0.5 | 10 | | 20 | 3 | 85 | 11.0 | 9.1 | 90.8 | 97.7 | 73.1 | 32.2 |
| 3A | 6 | 5 | 3 | 0.5 | 0.5 | 20 | | 20 | 3 | 85 | 11.1 | 8.9 | 92.4 | 105.1 | 73.1 | 32.2 |
| C2 | 4 | 2.5 | 3 | 0.5 | 0 | 0 | | 20 | 2.0 | 80 | 10.5 | 7.9 | 81.6 | 56.2 | 77.2 | 43.8 |
| 1B | 4 | 2.5 | 3 | 0.5 | 0 | 5 | | 20 | 2.0 | 80 | 10.4 | 8.0 | 85.2 | 75.9 | 77.2 | 43.8 |
| 2B | 4 | 2.5 | 3 | 0.5 | 0 | 10 | | 20 | 2.0 | 80 | 10.4 | 8.2 | 84.8 | 75.4 | 77.2 | 43.8 |
| 3B | 4 | 2.5 | 3 | 0.5 | 0 | 20 | | 20 | 2.0 | 80 | 10.4 | 7.8 | 87.0 | 87.2 | 77.2 | 43.8 |
| C3 | 5 | 2.5 | 4 | 0.7 | 0 | 0 | | 20 | 2.0 | 80 | 10.4 | 8.3 | 81.9 | 55.4 | 77.2 | 43.8 |
| 4B | 5 | 2.5 | 4 | 0.7 | 0 | 5 | | 20 | 2.0 | 80 | 10.4 | 8.2 | 85.8 | 77.5 | 77.2 | 43.8 |
| 5B | 5 | 2.5 | 4 | 0.7 | 0 | 10 | | 20 | 2.0 | 80 | 10.4 | 8.6 | 85.7 | 78.3 | 77.2 | 43.8 |
| 6B | 5 | 2.5 | 4 | 0.7 | 0 | 20 | | 20 | 2.0 | 80 | 10.4 | 8.1 | 88.9 | 95.5 | 77.2 | 43.8 |
| C4 | 5 | 2.5 | 5 | 1 | 0 | 0 | | 20 | 2.0 | 80 | 10.3 | 8.2 | 82.2 | 57.2 | 77.2 | 43.8 |
| 7B | 5 | 2.5 | 5 | 1 | 0 | 5 | | 20 | 2.0 | 80 | 10.5 | 8.4 | 85.5 | 75.2 | 77.2 | 43.8 |
| 8B | 5 | 2.5 | 5 | 1 | 0 | 10 | | 20 | 2.0 | 80 | 10.4 | 7.8 | 89.1 | 93.5 | 77.2 | 43.8 |
| 9B | 5 | 2.5 | 5 | 1 | 0 | 20 | | 20 | 2.0 | 80 | 10.5 | 8.5 | 89.4 | 98.0 | 77.2 | 43.8 |
| C5 | 2 | 1.5 | 3 | 0.5 | 0 | 0 | | 20 | 1.0 | 80 | 10.4 | 7.6 | 80.7 | 52.3 | 77.2 | 43.8 |
| C6 | 4 | 2.5 | 3 | 0.5 | 0 | 0 | | 20 | 1.0 | 80 | 10.5 | 7.8 | 83.0 | 57.9 | 77.2 | 43.8 |

TABLE I-continued

| Aspen BCTMP | | | | | | | | | | | | | | | | |
|---|---|---|---|---|---|---|---|---|---|---|---|---|---|---|---|---|
| Ex No. | $H_2O_2$ (%) | NaOH (%) | $Na_2SiO_3$ (%) | [1]DTPA (%) | $MgSO_4$ (%) | [2]AP (#/ton) | [3]T (#/ton) | [4]C (%) | Time hrs | T° C. | Initial pH | Final pH | Final ISO | Final CIE | Initial ISO | Initial CIE |
| C7 | 6 | 3.5 | 3 | 0.5 | 0 | 0 | | 20 | 1.0 | 80 | 10.8 | 8.2 | 83.9 | 61.7 | 77.2 | 43.8 |
| C8 | 2 | 1.5 | 3 | 0.5 | 0 | 0 | | 20 | 3.0 | 80 | 10.4 | 7.1 | 80.6 | 51.5 | 77.2 | 43.8 |
| C9 | 4 | 2.5 | 3 | 0.5 | 0 | 0 | | 20 | 3.0 | 80 | 10.5 | 7.2 | 83.6 | 59.4 | 77.2 | 43.8 |
| C10 | 6 | 3.5 | 3 | 0.5 | 0 | 0 | | 20 | 3.0 | 80 | 10.8 | 7.8 | 84.7 | 64.3 | 77.2 | 43.8 |
| C11 | 2 | 1.5 | 3 | 1 | 0 | 0 | | 20 | 1.0 | 80 | 10.7 | 7.9 | 80.1 | 51.2 | 77.2 | 43.8 |
| C12 | 4 | 2.5 | 3 | 1 | 0 | 0 | | 20 | 1.0 | 80 | 10.6 | 7.7 | 82.9 | 57.7 | 77.2 | 43.8 |
| C13 | 6 | 3.5 | 3 | 1 | 0 | 0 | | 20 | 1.0 | 80 | 10.9 | 8.0 | 84.2 | 61.6 | 77.2 | 43.8 |
| C14 | 2 | 1.5 | 3 | 1 | 0 | 0 | | 20 | 3.0 | 80 | 10.7 | 7.3 | 79.9 | 50.6 | 77.2 | 43.8 |
| C15 | 4 | 2.5 | 3 | 1 | 0 | 0 | | 20 | 3.0 | 80 | 10.6 | 7.4 | 83.1 | 58.6 | 77.2 | 43.8 |
| C16 | 6 | 3.5 | 3 | 1 | 0 | 0 | | 20 | 3.0 | 80 | 10.9 | 7.5 | 85.0 | 63.4 | 77.2 | 43.8 |
| 10B | 6 | 3.5 | 3 | 1 | 0 | 5 | | 20 | 1.0 | 80 | 10.8 | 8.1 | 89.0 | 89.2 | 77.2 | 43.8 |
| 11B | 6 | 3.5 | 3 | 1 | 0 | 10 | | 20 | 1.0 | 80 | 10.7 | 8.1 | 88.6 | 90.0 | 77.2 | 43.8 |
| 12B | 6 | 3.5 | 3 | 1 | 0 | 20 | | 20 | 1.0 | 80 | 10.7 | 8.5 | 90.6 | 100.6 | 77.2 | 43.8 |
| 13B | 6 | 3.5 | 3 | 1 | 0 | 5 | | 20 | 3.0 | 80 | 10.8 | 7.8 | 89.6 | 90.4 | 77.2 | 43.8 |
| 14B | 6 | 3.5 | 3 | 1 | 0 | 10 | | 20 | 3.0 | 80 | 10.7 | 8.1 | 90.7 | 97.8 | 77.2 | 43.8 |
| 15B | 6 | 3.5 | 3 | 1 | 0 | 20 | | 20 | 3.0 | 80 | 10.7 | 7.9 | 92.2 | 104.5 | 77.2 | 43.8 |
| C17 | 6 | 5 | 3 | 1 | 0 | 0 | | 20 | 2.5 | 85 | 10.9 | 8.8 | 83.5 | 63.5 | 77.2 | 43.8 |
| 16B | 6 | 5 | 3 | 1 | 0 | 5 | | 20 | 2.5 | 85 | 11.0 | 8.8 | 90.1 | 98.4 | 77.2 | 43.8 |
| 17B | 6 | 5 | 3 | 1 | 0 | 10 | | 20 | 2.5 | 85 | 11.0 | 8.9 | 91.7 | 104.4 | 77.2 | 43.8 |
| 18B | 6 | 5 | 3 | 1 | 0 | 20 | | 20 | 2.5 | 85 | 11.0 | 9.0 | 93.2 | 112.1 | 77.2 | 43.8 |
| C18 | 6 | 5 | 3 | 0.5 | 0.5 | 0 | | 20 | 3.0 | 85 | 11.0 | 9.0 | 84.9 | 65.3 | 77.2 | 43.8 |
| 19B | 6 | 5 | 3 | 0.5 | 0.5 | 5 | | 20 | 3.0 | 85 | 11.0 | 9.1 | 91.2 | 99.9 | 77.2 | 43.8 |
| 20B | 6 | 5 | 3 | 0.5 | 0.5 | 10 | | 20 | 3.0 | 85 | 11.0 | 9.1 | 93.1 | 108.5 | 77.2 | 43.8 |
| 21B | 6 | 5 | 3 | 0.5 | 0.5 | 20 | | 20 | 3.0 | 85 | 11.0 | 9.2 | 94.0 | 113.8 | 77.2 | 43.8 |
| C19 | 6 | 3 | 3 | 0.5 | 0.5 | 0 | | 20 | 2 | 85 | 10.8 | NM | 84.4 | 61.6 | 77.2 | 43.8 |
| 22B | 0 | 0 | 0 | 0 | 0 | 5 | | 10 | 2 | 65 | 9.2 | 8.4 | 90.1 | 91.4 | 77.2 | 43.8 |
| 23B | 0 | 0 | 0 | 0 | 0 | 10 | | 10 | 2 | 65 | 9.2 | NM | 91.9 | 100.6 | 77.2 | 43.8 |
| 24B | 0 | 0 | 0 | 0 | 0 | 20 | | 10 | 2 | 65 | 9.2 | NM | 93.4 | 108.2 | 77.2 | 43.8 |
| C20 | 0 | 0 | 0 | 0 | 0 | | 0 | 5 | .02 | 25 | 7.0 | 7.0 | — | — | 77.2 | 43.8 |
| C21 | 0 | 0 | 0 | 0 | 0 | | 5 | 5 | 02 | 25 | 7.0 | 7.0 | 78.5 | 48.3 | 77.2 | 43.8 |
| C22 | 0 | 0 | 0 | 0 | 0 | | 10 | 5 | 02 | 25 | 7.0 | 7.0 | 78.6. | 48.3 | 77.2 | 43.8 |
| C23 | 0 | 0 | 0 | 0 | 0 | | 20 | 5 | 02 | 25 | 7.0 | 7.0 | 79.3 | 52.8 | 77.2 | 43.8 |
| C24 | 0 | 0 | 0 | 0 | 0 | | 40 | 5 | 02 | 25 | 7.0 | 7.0 | 80.2 | 57.6 | 77.2 | 43.8 |
| C25 | 0 | 0 | 0 | 0 | 0 | 0 | | 5 | .02 | 25 | 7.0 | 7.0 | — | — | 77.2 | 43.8 |
| C26 | 0 | 0 | 0 | 0 | 0 | 5 | | 5 | 02 | 25 | 7.0 | 7.0 | 80.1 | 57.9 | 77.2 | 43.8 |
| C27 | 0 | 0 | 0 | 0 | 0 | 10 | | 5 | 02 | 25 | 7.0 | 7.0 | 80.9 | 63.1 | 77.2 | 43.8 |
| C28 | 0 | 0 | 0 | 0 | 0 | 20 | | 5 | 02 | 25 | 7.0 | 7.0 | 81.8 | 68.5 | 77.2 | 43.8 |
| C29 | 0 | 0 | 0 | 0 | 0 | 40 | | 5 | 02 | 25 | 7.0 | 7.0 | 83 | 75 | 77.2 | 43.8 |
| C30 | 2 | 1.25 | 3 | 1 | | 0 | | 20 | 2.0 | 80 | 10.8 | 9.5 | 84.3 | 66.6 | 82.4 | 57.1 |
| 1C | 2 | 1.25 | 3 | 1 | | 5 | | 20 | 2.0 | 80 | 10.9 | 9.9 | 89.6 | 94.9 | 82.4 | 57.1 |
| 2C | 2 | 1.25 | 3 | 1 | | 10 | | 20 | 2.0 | 80 | 11.0 | 9.3 | 91.3 | 105.6 | 82.4 | 57.1 |
| 3C | 2 | 1.25 | 3 | 1 | | 20 | | 20 | 2.0 | 80 | 11.0 | 9.4 | 92.7 | 110.3 | 82.4 | 57.1 |
| C31 | 4 | 2.5 | 3 | 1 | | 0 | | 20 | 2.0 | 80 | 10.8 | 9.5 | 84.7 | 76.1 | 82.4 | 57.1 |
| 4C | 4 | 2.5 | 3 | 1 | | 5 | | 20 | 2.0 | 80 | 10.9 | 9.9 | 91.5 | 113.1 | 82.4 | 57.1 |
| 5C | 4 | 2.5 | 3 | 1 | | 10 | | 20 | 2.0 | 80 | 11.0 | 9.3 | 94.2 | 113.9 | 82.4 | 57.1 |
| 6C | 4 | 2.5 | 3 | 1 | | 20 | | 20 | 2.0 | 80 | 11.0 | 9.4 | 97.4 | 126.3 | 82.4 | 57.1 |
| 7C | 5 | 2.5 | 3 | 1 | | 20 | | 20 | 1.0 | 80 | 10.5 | 10.1 | 92.7 | 111.4 | 82.4 | 57.1 |
| 8C | 5 | 2.5 | 3 | 1 | | 20 | | 20 | 2.0 | 80 | 10.5 | 9.8 | 94.6 | 119.8 | 82.4 | 57.1 |
| 9C | 5 | 2.5 | 3 | 1 | | 20 | | 20 | 4.0 | 80 | 10.5 | 9.5 | 95.6 | 123.2 | 82.4 | 57.1 |
| 10C | 5 | 2.5 | 3 | 1 | 0 | 20 | | 20 | 1 | 80 | 10.5 | 10.1 | 92.7 | 111.4 | 82.4 | 57.1 |
| 11C | 5 | 2.5 | 3 | 1 | 0 | 20 | | 20 | 2 | 80 | 10.5 | 9.8 | 94.6 | 119.8 | 82.4 | 57.1 |
| 12C | 5 | 2.5 | 3 | 1 | 0 | 20 | | 20 | 4 | 80 | 10.5 | 9.5 | 95.6 | 123.2 | 82.4 | 57.1 |
| C32 | 6 | 5 | 3 | 0.5 | 0.5 | | 0 | 20 | 3 | 85 | 11.5 | 10.1 | 86.4 | 74.7 | 82.4 | 57.1 |
| 13C | 6 | 5 | 3 | 0.5 | 0.5 | | 5 | 20 | 3 | 85 | NM | 10.0 | 92.8 | 113.1 | 82.4 | 57.1 |
| 14C | 6 | 5 | 3 | 0.5 | 0.5 | | 10 | 20 | 3 | 85 | NM | 10.1 | 94.9 | 119.4 | 82.4 | 57.1 |
| 15C | 6 | 5 | 3 | 0.5 | 0.5 | | 20 | 20 | 3 | 85 | 11.4 | 10.0 | 95.9 | 126.0 | 82.4 | 57.1 |
| C33 | 0 | 0 | 0 | 0 | 0 | | 0 | 5 | .02 | 25 | 7.0 | 7.0 | — | — | 82.4 | 57.1 |
| C34 | 0 | 0 | 0 | 0 | 0 | | 5 | 5 | 02 | 25 | 7.0 | 7.0 | 83.0 | 60.9 | 82.4 | 57.1 |
| C35 | 0 | 0 | 0 | 0 | 0 | | 10 | 5 | 02 | 25 | 7.0 | 7.0 | 83.9 | 64.1 | 82.4 | 57.1 |
| C36 | 0 | 0 | 0 | 0 | 0 | | 20 | 5 | 02 | 25 | 7.0 | 7.0 | 84.1 | 68.6 | 82.4 | 57.1 |
| C37 | 0 | 0 | 0 | 0 | 0 | | 40 | 5 | 02 | 25 | 7.0 | 7.0 | 84.2 | 67.6 | 82.4 | 57.1 |
| C38 | 0 | 0 | 0 | 0 | 0 | 0 | | 5 | .02 | 25 | 7.0 | 7.0 | — | — | 82.4 | 57.1 |
| C39 | 0 | 0 | 0 | 0 | 0 | 5 | | 5 | 02 | 25 | 7.0 | 7.0 | 85.2 | 71.4 | 82.4 | 57.1 |
| C40 | 0 | 0 | 0 | 0 | 0 | 10 | | 5 | 02 | 25 | 7.0 | 7.0 | 86.2 | 78.3 | 82.4 | 57.1 |
| C41 | 0 | 0 | 0 | 0 | 0 | 20 | | 5 | 02 | 25 | 7.0 | 7.0 | 87.2 | 83.9 | 82.4 | 57.1 |
| C42 | 0 | 0 | 0 | 0 | 0 | 40 | | 5 | 02 | 25 | 7.0 | 7.0 | 88.9 | 93 | 82.4 | 57.1 |
| C43 | 0 | 0 | 0 | 0 | | 20 | | 10 | 1.5 | 72 | 10.5 | NM | 86.8 | 87.4 | 82.4 | 59.2 |
| C44 | 0 | 0 | 5 | 0 | | 20 | | 10 | 1.5 | 72 | 10.5 | NM | 84.1 | 87.5 | 82.4 | 59.2 |
| C45 | 0 | 0 | 0 | 1 | | 20 | | 10 | 1.5 | 72 | 10.5 | NM | 82.3 | 84.3 | 82.4 | 59.2 |
| C46 | 0 | 0 | 0 | 0 | | 20 | | 10 | 2.0 | 72 | 10.5 | NM | 88.6 | 95.1 | 82.4 | 59.2 |
| C47 | 0 | 0 | 0 | 0 | | 20 | | 12 | 2.0 | 65 | 7.4 | NM | 89.9 | 98.3 | 82.4 | 59.2 |
| C48 | 0 | 0 | 0 | 0 | | 20 | | 12 | 4.0 | 65 | 7.4 | NM | 89.6 | 96.7 | 82.4 | 59.2 |
| 1D | 1 | 0 | 0 | 0 | | 20 | | 12 | 2.0 | 65 | 6.9 | 6.6 | 90.6 | 98.8 | 82.4 | 59.2 |
| 2D | 1 | 0 | 0 | 0.5 | | 20 | | 12 | 2.0 | 65 | 7.4 | 7.2 | 90.7 | 99.8 | 82.4 | 59.2 |
| 3D | 1 | 0 | 0 | 0 | | 20 | | 12 | 4.0 | 65 | 6.9 | 6.7 | 90.8 | 99.3 | 82.4 | 59.2 |

TABLE I-continued

| Aspen BCTMP | | | | | | | | | | | | | | | | |
|---|---|---|---|---|---|---|---|---|---|---|---|---|---|---|---|---|
| Ex No. | $H_2O_2$ (%) | NaOH (%) | $Na_2SiO_3$ (%) | [1]DTPA (%) | $MgSO_4$ (%) | [2]AP (#/ton) | [3]T (#/ton) | [4]C (%) | Time hrs | T° C. | Initial pH | Final pH | Final ISO | Final CIE | Initial ISO | Initial CIE |
| 4D | 1 | 0 | 0 | 0.5 | | 20 | | 12 | 4.0 | 65 | 7.4 | 7.2 | 90.9 | 99.7 | 82.4 | 59.2 |
| C49 | 2 | 1.5 | 3 | 0.5 | 0 | 0 | | 20 | 1.0 | 80 | 10.4 | 7.6 | 80.7 | 52.3 | 77.2 | 43.8 |
| C50 | 4 | 2.5 | 3 | 0.5 | 0 | 0 | | 20 | 1.0 | 80 | 10.5 | 7.8 | 83.0 | 57.9 | 77.2 | 43.8 |
| C51 | 6 | 3.5 | 3 | 0.5 | 0 | 0 | | 20 | 1.0 | 80 | 10.8 | 8.2 | 83.9 | 61.7 | 77.2 | 43.8 |
| | | | | | | | | | | | | | | | 77.2 | 43.8 |
| C52 | 2 | 1.5 | 3 | 0.5 | 0 | 0 | | 20 | 3.0 | 80 | 10.4 | 7.1 | 80.6 | 51.5 | 77.2 | 43.8 |
| C53 | 4 | 2.5 | 3 | 0.5 | 0 | 0 | | 20 | 3.0 | 80 | 10.5 | 7.2 | 83.6 | 59.4 | 77.2 | 43.8 |
| C54 | 6 | 3.5 | 3 | 0.5 | 0 | 0 | | 20 | 3.0 | 80 | 10.8 | 7.8 | 84.7 | 64.3 | 77.2 | 43.8 |
| | | | | | | | | | | | | | | | 77.2 | 43.8 |
| C55 | 2 | 1.5 | 3 | 1 | 0 | 0 | | 20 | 1.0 | 80 | 10.7 | 7.9 | 80.1 | 51.2 | 77.2 | 43.8 |
| C56 | 4 | 2.5 | 3 | 1 | 0 | 0 | | 20 | 1.0 | 80 | 10.6 | 7.7 | 82.9 | 57.7 | 77.2 | 43.8 |
| C57 | 6 | 3.5 | 3 | 1 | 0 | 0 | | 20 | 1.0 | 80 | 10.9 | 8.0 | 84.2 | 61.6 | 77.2 | 43.8 |
| | | | | | | | | | | | | | | | 77.2 | 43.8 |
| C58 | 2 | 1.5 | 3 | 1 | 0 | 0 | | 20 | 3.0 | 80 | 10.7 | 7.3 | 79.9 | 50.6 | 77.2 | 43.8 |
| C59 | 4 | 2.5 | 3 | 1 | 0 | 0 | | 20 | 3.0 | 80 | 10.6 | 7.4 | 83.1 | 58.6 | 77.2 | 43.8 |
| C60 | 6 | 3.5 | 3 | 1 | 0 | 0 | | 20 | 3.0 | 80 | 10.9 | 7.5 | 85.0 | 63.4 | 77.2 | 43.8 |

In Table I, "DTP" is diethylene triamine pentacetic acid, "AP" is Leucophor AP, "T" is Leucophor T-100, and "C" is pulp consistency.

Examples 1E to 3G and Comparative Examples C60 to C60

Using the procedure of Examples 1A to 10 D and Comparative Examples C1 to C34, a series of experiments were carried out to Spruce CTMP pulp is treated bleach chemical solutions containing the desired amounts of $H_2O_2$, NaOH and optionally OBA, chelating and stabilization chemicals. One purpose of these experiments is to demonstrate the effect of effect of treatment time, duration of the treatment, temperature, consistency and chemical additives (Leucophor AP, $H_2O_2$, $Na_2SiO_3$, DTPA) on the ISO brightness and the CIE Whiteness of the treated Spruce CTMP pulp.

The specific process conditions and the results of the evaluation are set forth in the following Table II.

TABLE II

| Spruce CTMP | | | | | | | | | | | | | | |
|---|---|---|---|---|---|---|---|---|---|---|---|---|---|---|
| Example No. | $H_2O_2$ (%) | NaOH (%) | $Na_2SiO_3$ (%) | DTPA (%) | Cons (%) | Time hrs | Temp ° C. | Initial pH | Final pH | OBA (#/ton) | Final CIE | Final ISO | Initial ISO | Initial CIE |
| C61 | 1 | 2.5 | 1 | 0 | 10 | 2 | 85 | 11.3 | 9.3 | 0 | −15.6 | 56.6 | 58.2 | 3.5 |
| C62 | 2 | 2.5 | 1 | 0 | 10 | 2 | 85 | 11.0 | 8.6 | 0 | 9.8 | 65.8 | 58.2. | 3.5 |
| C63 | 3 | 2.5 | 1 | 0 | 10 | 2 | 85 | 10.8 | 8.0 | 0 | 21.3 | 70.1 | 58.2 | 3.5 |
| C64 | 4 | 2.5 | 3 | 0 | 12 | 2 | 80 | 10.9 | 10.4 | 0 | 41.4 | 77.3 | 70.1 | 21.3 |
| C65 | 4 | 2.5 | 3 | 0.5 | 12 | 2 | 80 | 10.7 | 9.0 | 0 | 34.7 | 74.7 | 58.2 | 3.5 |
| C66 | 4 | 2.5 | 3 | 0.5 | 20 | 2 | 80 | 11.0 | 10.3 | 0 | 49.6 | 79.7 | 74.7 | 34.7 |
| C67 | 4 | 2.5 | 3 | 0.5 | 12 | 2 | 80 | 10.7 | 9.0 | 0 | 34.7 | 74.7 | 58.2 | 3.5 |
| C68 | 0 | 0 | 0 | 0 | 10 | 2 | 65 | 7.4 | | 10 | 44.7 | 74.9 | 74.7 | 34.7 |
| C69 | 0 | 0 | 0 | 0 | 10 | 2 | 65 | 7.1 | | 20 | 51.2 | 77.2 | 74.7 | 34.7 |
| C70 | 0 | 0 | 0 | 0 | 10 | 2 | 65 | 7.0 | | 30 | 54.7 | 77.5 | 74.7 | 34.7 |
| C71 | 3 | 2.5 | 1 | 0 | 10 | 2 | 85 | 10.8 | 8.0 | 0 | 21.3 | 70.1 | 58.2 | 3.5 |
| C72 | 4 | 2.5 | 3 | 0 | 12 | 2 | 80 | 10.9 | 10.4 | 0 | 41.4 | 77.3 | 70.1 | 21.3 |
| C73 | 0 | 0 | 0 | 0 | 10 | 2 | 65 | 11.2 | 10.8 | 5 | 52.9 | 78.5 | 77.3 | 41.4 |
| C74 | 0 | 0 | 0 | 0 | 10 | 2 | 65 | 11.2 | 10.7 | 10 | 68.4 | 81.6 | 77.3 | 41.4 |
| C75 | 0 | 0 | 0 | 0 | 10 | 2 | 65 | 11.2 | 10.7 | 20 | 73.4 | 82.1 | 77.3 | 41.4 |
| C76 | 4 | 2.5 | 3 | 0.5 | 12 | 2 | 80 | 10.7 | 9.0 | 0 | 34.7 | 74.7 | 58.2 | 3.5 |
| C77 | 4 | 2.5 | 3 | 0.5 | 20 | 2 | 80 | 11.0 | 10.3 | 0 | 49.6 | 79.7 | 74.7 | 34.7 |
| C78 | 0 | 0 | 0 | 0 | 10 | 2 | 65 | 7.5 | | 10 | 60.9 | 80.0 | 79.7 | 49.6 |
| C79 | 0 | 0 | 0 | 0 | 10 | 2 | 65 | 7.5 | | 20 | 66.0 | 81.1 | 79.7 | 49.6 |
| C80 | 0 | 0 | 0 | 0 | 10 | 2 | 65 | 7.3 | | 30 | 70.8 | 82.0 | 79.7 | 49.6 |
| C81 | 4 | 3 | 3 | 0.5 | 20 | 2 | 80 | 10.6 | 8.9 | 0 | 38.2 | 76.1 | 58.2 | 3.5 |
| 1E | 4 | 3 | 3 | 0.5 | 20 | 2 | 80 | 10.8 | 8.8 | 10 | 60.0 | 79.6 | 76.1 | 38.2 |
| 2E | 4 | 3 | 3 | 0.5 | 20 | 2 | 80 | 10.8 | 9.0 | 20 | 66.2 | 80.6 | 79.6 | 60.0 |
| C82 | 3 | 2.5 | 1 | 0 | 10 | 2 | 85 | 10.8 | 8.0 | 0 | 21.3 | 70.1 | 58.2 | 3.5 |
| C83 | 4 | 2.5 | 3 | 0.5 | 12 | 2 | 80 | 10.8 | 10.3 | 0 | 41.6 | 77.4 | 70.1 | 21.3 |
| 1F | 4 | 2.5 | 3 | 0.5 | 12 | 2 | 80 | 10.8 | 10.2 | 5 | 59.3 | 80.0 | 70.1 | 21.3 |
| 2F | 4 | 2.5 | 3 | 0.5 | 12 | 2 | 80 | 10.9 | 10.3 | 10 | 67.7 | 81.7 | 70.1 | 21.3 |
| 3F | 4 | 2.5 | 3 | 0.5 | 12 | 2 | 80 | 10.8 | 10.3 | 20 | 75.8 | 82.8 | 70.1 | 21.3 |
| C84 | 4 | 2.5 | 3 | 0.5 | 12 | 2 | 80 | 10.7 | 9.0 | 0 | 34.7 | 74.7 | 58.2 | 3.5 |
| C85 | 4 | 2.5 | 3 | 0.5 | 20 | 2 | 80 | 11.0 | 10.3 | 0 | 49.6 | 79.7 | 74.7 | 34.7 |
| 1G | 4 | 2.5 | 3 | 0.5 | 20 | 2 | 80 | 10.9 | 10.2 | 5 | 64.4 | 81.9 | 74.7 | 34.7 |
| 2G | 4 | 2.5 | 3 | 0.5 | 20 | 2 | 80 | 11.0 | 10.3 | 10 | 70.1 | 83.3 | 74.7 | 34.7 |
| 3G | 4 | 2.5 | 3 | 0.5 | 20 | 2 | 80 | 10.7 | 10.3 | 20 | 76.9 | 84.3 | 74.7 | 34.7 |

Examples 1H to 3H

Using the procedure of Examples 1A to 10 D and Comparative Examples C1 to C34, a series of experiments were carried out to treat Aspen BCTMP pulp with bleach chemical solutions. The bleaching solution contained 6% $H_2O_2$, 5% NaOH, 3% $Na_2SiO_3$, 0.5% DTPA and 0.5% $MgSO_4$. The bleaching mixture was mixed with pulp at a consistency of 20% and bleach at a temperature of 85° C. for 2 hours at an initial pH of 10.8. The final ISO brightness was 84.4 and the final CIE whiteness was 61.6. After bleaching was completed, then OBA Leucophor AP was added to the mixture of pulp and spent bleaching chemicals and the consistency reduced to 10%. One purpose of these experiments is to demonstrate the effect on the ISO brightness and the CIE Whiteness of the treated Aspen BCTMP pulp when the pulp is treated with OBA in the presence of spent bleaching chemicals.

The specific process conditions and the results of the evaluation are set forth in the following Table III.

TABLE III

| Example No. | OBA (#/ton) | Time hrs | T° C. | Initial pH | Final pH | Final ISO | Final CIE |
|---|---|---|---|---|---|---|---|
| 1H | 5 | 2 | 65 | 9.2 | 8.4 | 90.1 | 91.4 |
| 2H | 10 | 2 | 65 | 9.2 | — | 91.9 | 100.6 |
| 3H | 20 | 2 | 65 | 9.2 | — | 93.4 | 108.2 |

Example 1I

A series of experiments were conducted determine the relative to the cross sectional distribution of the optical brightener in the pulp of this invention and pulp treated with OBA using conventional processes. The pulp sample of this invention evaluated was that of Example 6C and one of the conventionally brightened pulps was that of Example C23. The other conventional pulp analyzed was similar to that of Example C23 except that it was treated at a consistency of 1%. In these experiments, a small specimen was cut from each handsheet and embedded in embedding medium. Cross sections were prepared and examined under an optical microscope using UV/Fluorescence illumination. Photomicrographs were taken at 216× and 432× using our Tectronic analog camera to show OBA distribution and intensity. The results are set for the in FIGS. 21 to 24. The photomicrographs of the sample of Example 6C are shown in FIGS. 19 and 22, the photomicrographs of the sample of Example C23 are shown in FIGS. 20 and 23, and the photomicrographs of the samples of the other conventionally brightened pulp are shown in FIGS. 21 and 24. The sample of Example 6C showed much stronger fluorescence signals than the other test samples.

What is claimed is:

1. An improved process for manufacturing brightened mechanical pulp comprising at least one bleaching stage comprising treating the pulp with one or more optical brightening agents at an amount of from about 0.1% to about 2% based on the dry weight of the pulp in the presence of one or more active bleaching agents and one or more silicate stabilizers, wherein the active bleaching agents are selected from the group consisting of oxidative bleaching agents other than chlorine based bleaching agents;

wherein the treating is carried out for at least about 60 minutes; and said brightened mechanical pulp has an ISO Brightness of at least 90 ISO points to about 97.4 ISO points.

2. A process according to claim 1 wherein said bleaching agent comprises peroxide.

3. The method according to claim 1, wherein the pulp has at least one plant source selected from the group consisting of a tree, aspen, eucalyptus, maple, birch, walnut, acacia, hardwood tree, softwood tree, spruce, pine, cedar, non-woody herbaceous plant, kenaf, hemp, jute, flax, sisal, abaca.

4. The method according to claim 1, wherein the pulp is at a consistency of from about 3% to about 25%.

5. The method according to claim 1, wherein the one or more optical brightening agent is present at an amount that is at least about 0.1% based on the dry weight of the pulp.

6. The method according to claim 1, wherein the one or more optical brightening agent is present at an amount of from about 0.1% to about 2% based on the dry weight of the pulp.

7. The method according to claim 1, wherein the one or more bleaching agent is present at an amount that is at least about 1% based on the dry weight of the pulp.

8. The method according to claim 1, wherein the one or more bleaching agent is present at an amount of from about 1% to about 8% based on the dry weight of the pulp.

9. The method according to claim 1, wherein the one or more bleaching agent comprises hydrogen peroxide at an amount of from about 10 to about 200 pounds per ton of pulp on a dry basis.

10. The method according to claim 1, wherein the treating step is performed in the further presence of at least one member selected from the group consisting of a second stabilizer, chelating agent, and bleaching aid.

11. The method according to claim 1, wherein the treating step is performed at a temperature ranging from about 25° C. to about 120° C.

12. The method according to claim 1, wherein the treating step is performed at a pH equal to or greater than about 7.

13. The method according to claim 1, further comprising mechanically refining the pulp directly prior to the bleaching stage.

14. The method according to claim 1, wherein the silicate stabilizer is sodium silicate.

15. The method according to claim 1, wherein the silicate stabilizer is present in an amount up to about 10% by weight.

16. The method according to claim 1, further comprising treating the pulp with the one or more optical brightening agents, the one or more active bleaching agents, and the one or more silicate stabilizers in the presence of sodium hydroxide.

17. An improved process for forming bleached mechanical pulp of the type comprising:

(a) a mechanical refining stage wherein wood chips are mechanically refined to form mechanical refined wood pulp; and (b) a bleaching stage wherein said mechanical refined wood pulp is bleached in one or more bleaching stages to form a bleached mechanical refined wood pulp;

the improvement comprising bleaching the mechanical refined wood pulp with one or more active bleaching agents and one or more silicate stabilizers in the presence of one or more optical brightening agents at an amount of from about 0.1% to about 2% based on the dry weight of the pulp, said bleaching agents selected from the group consisting of oxidative bleaching agents other than chlorine based bleaching agents;

wherein the bleaching is carried out for at least about 60 minutes; and said bleached mechanical refined wood pulp has an ISO Brightness of at least 90 ISO points to about 97.4 ISO points.

18. The method according to claim 17, wherein the silicate stabilizer is sodium silicate.

19. The method according to claim 17, wherein the silicate stabilizer is present in an amount up to about 10% by weight.

20. The method according to claim 17, further comprising bleaching the pulp with the one or more active bleaching agents, the one or more silicate stabilizers, and the one or more optical brightening agents in the presence of sodium hydroxide.

21. An improved pulping and paper making process of the type comprising:

(a) a mechanical refining stage wherein wood chips are mechanically refined to form mechanical refined wood pulp, (b) a bleaching stage wherein said mechanically refined wood pulp is bleached in one or more bleaching stages to form bleached mechanical refined aspen wood pulp, (c) a furnish forming stage wherein an aqueous paper making stock furnish comprising said bleached mechanical refined wood pulp is formed;

(d) a furnish depositing stage wherein said furnish is deposited on a forming wire of a paper making machine to form a wet paper web; and (e) a wet paper web drying stage wherein said wet paper web to form a first dried paper web;

the improvement comprising bleaching the mechanical refined wood pulp with one or more active bleaching agents and one or more silicate stabilizers in the presence of one or more optical brightening agents at an amount of from about 0.1% to about 2% based on the dry weight of the pulp, said bleaching agents selected from the group consisting of oxidative bleaching agents other than chlorine based bleaching agents;

wherein the bleaching is carried out for at least about 60 minutes; and said bleached mechanical refined wood pulp has an ISO brightness of at least 90 ISO points to about 97.4 ISO points.

22. The method according to claim 21, wherein the silicate stabilizer is sodium silicate.

23. The method according to claim 21, wherein the silicate stabilizer is present in an amount up to about 10% by weight.

24. The method according to claim 21, further comprising bleaching the pulp with the one or more active bleaching agents, the one or more silicate stabilizers, and the one or more optical brightening agents in the presence of sodium hydroxide.

* * * * *